US006465164B1

(12) United States Patent
Aylward et al.

(10) Patent No.: US 6,465,164 B1
(45) **Date of Patent: *Oct. 15, 2002**

(54) REFLECTIVE IMAGING ELEMENT WITH EXPANDED COLOR GAMUT

(75) Inventors: Peter T. Aylward, Hilton; Alphonse D. Camp; James L. Edwards, both of Rochester; Robert P. Bourdelais, Pittsford, all of NY (US)

(73) Assignee: Eastman Kodak Company, Rochester, NY (US)

( * ) Notice: Subject to any disclaimer, the term of this patent is extended or adjusted under 35 U.S.C. 154(b) by 68 days.

This patent is subject to a terminal disclaimer.

(21) Appl. No.: 09/664,497

(22) Filed: Sep. 18, 2000

(51) Int. Cl.[7] ..... G03C 1/46

(52) U.S. Cl. ..... 430/505; 430/502; 430/503; 430/504; 430/508; 430/359; 430/363; 430/364; 430/523; 430/531; 430/536

(58) Field of Search ..... 430/505, 503, 430/504, 502, 359, 363, 364, 508, 523, 531, 536

(56) References Cited

U.S. PATENT DOCUMENTS

| | | | | |
|---|---|---|---|---|
| 4,705,745 | A | 11/1987 | Kitchin et al. | |
| 4,746,599 | A | 5/1988 | Deguchi et al. | |
| 4,816,378 | A | 3/1989 | Powers et al. | |
| 5,436,116 | A | 7/1995 | Hoshino et al. | |
| 5,437,969 | A | 8/1995 | Schmuck et al. | |
| 5,445,928 | A | 8/1995 | Schmuck et al. | |
| 5,447,831 | A | 9/1995 | Singer et al. | |
| 5,455,150 | A | 10/1995 | Mooberry et al. | |
| 5,486,450 | A | 1/1996 | Tosaka et al. | |
| 5,563,026 | A | 10/1996 | Singer | |
| 5,679,139 | A | 10/1997 | McInerney et al. | |
| 5,679,140 | A | 10/1997 | McInerney et al. | |
| 5,679,141 | A | 10/1997 | McInerney et al. | |
| 5,679,142 | A | 10/1997 | McInerney et al. | |
| 5,723,263 | A | 3/1998 | Singer et al. | |
| 5,866,282 | A | 2/1999 | Bourdelais et al. | |
| 6,030,742 | A | 2/2000 | Bourdelais et al. | |
| 6,071,654 | A | 6/2000 | Camp et al. | |
| 6,080,532 | A | 6/2000 | Cakmp et al. | |
| 6,093,521 | A | 7/2000 | Laney et al. | |
| 6,153,351 | A | 11/2000 | Gula et al. | |
| 6,159,674 | A | 12/2000 | Edwards | |
| 6,180,328 | B1 * | 1/2001 | Edwards et al. | 430/503 |
| 6,258,494 | B1 * | 7/2001 | Bourdelais et al. | 430/502 |
| 6,291,144 | B1 * | 9/2001 | Aylward et al. | 430/359 |
| 6,368,758 | B1 * | 4/2002 | Camp et al. | 430/505 |
| 6,368,759 | B1 * | 4/2002 | Bourdelais et al. | 430/505 |

FOREIGN PATENT DOCUMENTS

| | | |
|---|---|---|
| EP | 0 825 488 A1 | 2/1998 |
| EP | 0 915 374 A1 | 5/1999 |

* cited by examiner

*Primary Examiner*—Geraldine Letscher
(74) *Attorney, Agent, or Firm*—Paul A. Leipold

(57) ABSTRACT

This invention relates to a method of forming an image comprising providing an imaging element comprising a transparent polymer sheet, and at least one photo sensitive dye forming coupler containing layer is on each side of said sheet, wherein there are at least four separate photo sensitive layers and the photo sensitive layers comprise at least four dye forming couplers that form at least four spectrally distinct colors, image wise exposing said imaging element by actinic radiation, developing an image, and applying a white reflective sheet to one side of the developed imaging element.

43 Claims, 2 Drawing Sheets

REFLECTIVE IMAGING ELEMENT WITH EXPANDED COLOR GAMUT

FIELD OF THE INVENTION

This invention relates to an improved reflective silver halide photographic element for silver halide imaging systems. More specifically, it relates to such a reflective element comprising at least four separately sensitized light-sensitive silver halide emulsion layers containing, in addition to the three conventional cyan, magenta, and yellow dye-forming layers, a fourth image dye-forming layer comprising a coupler wherein the dye formed by that coupler has a CIELAB $h_{ab}$ hue angle in the range of from not less than 355° to not more than 75°, and/or a fifth image dye-forming layer comprising a coupler wherein the dye formed by that coupler has a hue angle in the range of from not less than 225° to not more than 310°, which increases the gamut of colors possible.

BACKGROUND OF THE INVENTION

Color gamut is an important feature of color printing and imaging systems. It is a measure of the range of colors that can be produced using a given combination of colorants. It is desirable for the color gamut to be as large as possible. The color gamut of the imaging system is controlled primarily by the absorption characteristics of the set of colorants used to produce the image. Silver halide imaging systems typically employ three colorants, typically including cyan, magenta, and yellow in the conventional subtractive imaging system.

The ability to produce an image containing any particular color is limited by the color gamut of the system and materials used to produce the image. Thus, the range of colors available for image reproduction is limited by the color gamut that the system and materials can produce.

Color gamut is often thought to be maximized by the use of so-called "block dyes". In *The Reproduction of Colour* $4^{th}$ ed., R. W. G. Hunt, pp 135–144, it has been suggested that the optimum gamut could be obtained with a subtractive three-color system using three theoretical block dyes where the blocks are separated at approximately 490 nm and 580 nm. This proposal is interesting but cannot be implemented for various reasons. In particular, there are no real organic based couplers which produce dyes corresponding to the proposed block dyes.

Variations in the block dye concept are advanced by Clarkson, M. E. and Vickerstaff, T. in "Brightness and Hue of Present-Day Dyes in Relation to Colour Photography," Photo. J. 88b, 26 (1948). Three example spectral shapes are given by Clarkson and Vickerstaff: Block, Trapezoidal, and Triangular. The authors conclude, contrary to the teachings of Hunt, that trapezoidal absorption spectra may be preferred to a vertical sided block dye. Again, dyes having these trapezoidal spectra shapes are theoretical and are not available in practice.

Both commercially available dyes and theoretical dyes were investigated in "The Color Gamut Obtainable by the Combination of Subtractive Color Dyes. Optimum Absorption Bands as Defined by Nonlinear Optimization Technique," J. Imaging Science, 30, 9–12. The author, N. Ohta, deals with the subject of real colorants and notes that the existing curve for a typical cyan dye, as shown in the publication, is the optimum absorption curve for cyan dyes from a gamut standpoint.

Bourdelais et al in U.S. Pat. No. 6,030,756 discusses imaging layers containing silver halide and dye forming couplers applied to both sides of a translucent base for a display material. While the display material in U.S. Pat. No. 6,030,756 provides an excellent image that can be displayed without the need for a backlight source, the image is only capable of reproducing 56% of Pantone color space.

McInerney et al in U.S. Pat. Nos. 5,679,139; 5,679,140; 5,679,141; and 5,679,142 teach the shape of preferred subtractive dye absorption shapes for use in four color, C,M,Y,K based ink-jet prints.

McInerney et al in EP 0 825 488 teaches the shape of preferred subtractive cyan dye absorption shape for use in silver halide based color prints.

Kitchin et al in U.S. Pat. No. 4,705,745 teaches the preparation of a photographic element for preparing half-tone color proofs comprising four separate imaging layers capable of producing cyan, magenta, yellow, and black images.

Powers et al in U.S. Pat. No. 4,816,378, teaches an imaging process for the preparation of color half-tone images that contain cyan, magenta, yellow, and black images. The use of the black dye does little to improve the gamut of color reproduction.

Haraga et al in EP 0 915 374 A1 teaches a method for improving image clarity by mixing 'invisible' information in the original scene with a color print and reproducing it as an infrared dye, magenta dye, or as a mixture of cyan magenta and yellow dyes to achieve improved color tone and realism. The addition of the resulting infrared, magenta, or black dye does little to improve the gamut.

In spite of the foregoing teachings relative to color gamut, the coupler sets which have been employed in silver halide color imaging have not provided the range of gamut desired for modem digital imaging; especially for so-called 'spot colors', or 'HiFi colors'.

It is, therefore, a problem to be solved by providing a coupler set which provides an increase in color gamut compared to coupler sets comprised of cyan, magenta, and yellow dye forming couplers by further incorporating red dye and blue dye forming couplers.

It has been proposed in U.S. Pat. No. 5,866,282 (Bourdelais et al) to utilize a composite support material with laminated biaxially oriented polyolefin sheets as a photographic imaging material. In U.S. Pat. No. 5,866,282, biaxially oriented polyolefin sheets are extrusion laminated to cellulose paper to create a support for silver halide imaging layers. The biaxially oriented sheets described in U.S. Pat. No. 5,866,282 have a microvoided layer in combination with coextruded layers that contain white pigments such as $TiO_2$ above and below the microvoided layer. In the composite imaging support structure described in U.S. Pat. No. 5,866,282 the cyan, magenta, and yellow silver halide imaging layers are applied to one side of the white, reflecting side of the base.

It has been proposed in U.S. Pat. No. 4,355,099 to apply photosensitive layers on one side of a thin transparent support, expose through the thin transparent support and post image process adhere the imaging layers to a white reflective support to create a reflective image. While the imaging layers are protected, they are only applied to one side of the thin transparent support. Further, because no antihalation layer is utilized with the light sensitive silver halide imaging layers, problems such as unwanted scattering and printing platen reflection would reduce the quality of the image.

PROBLEM TO BE SOLVED BY THE INVENTION

There is a need for a reflective imaging material that provides an expanded color gamut while maintaining processing efficiency.

SUMMARY OF THE INVENTION

It is an object of the invention to provide improved imaging layers.

It is another object to provide imaging material that has an expanded color gamut.

It is a further object to maintain processing efficiency.

It is another object to provide a reflective image.

These and other objects of the invention are accomplished by a method of forming an image comprising providing an imaging element comprising a transparent polymer sheet, and at least one photo sensitive dye forming coupler containing layer is on each side of said sheet, wherein there are at least four separate photo sensitive layers and the photo sensitive layers comprise at least four dye forming couplers that form at least four spectrally distinct colors, image wise exposing said imaging element by actinic radiation, developing an image, and applying a white reflective sheet to one side of the developed imaging element.

ADVANTAGEOUS EFFECT OF THE INVENTION

The invention provides a reflective imaging material with an improved color gamut while maintaining typical the 45 second color development cycle time.

DETAILED DESCRIPTION OF THE INVENTION

The invention has numerous advantages over prior practices in the art. The photographic element of the invention employs subtractive, additive, or a combination of subtractive and additive color imaging. In such imaging, a viewable digital print color image is formed by generating a combination of cyan, magenta, yellow, red, and blue or black colorants in proportion to the amounts of exposure of up to six different digitally controlled light sources respectively. The object is to provide a reproduction that is pleasing to the observer, but also has the improved capability to specifically reproduce the so-called 'spot colors', Pantone® colors or Hi-Fi colors. Color in the reproduced image is composed of one or a combination of the cyan, magenta, yellow, red, blue, and black image colorants. The relationship of the original color to the reproduced color is a combination of many factors. It is, however, limited by the color gamut achievable by the multitude of combinations of cyan, magenta, yellow, red, blue and black colorants used to generate the final image.

In addition to the individual colorant characteristics, it is necessary to have cyan, magenta, yellow, red, and blue colorants that have preferred absorption maxima relative to one another and that have absorption band shapes which function together to provide an optimum overall color gamut. The imaging element of the invention can be processed in 45 seconds, as the additional dyes and couplers required to expand the color gamut are applied to the back side of the transparent polymer sheet, as an additional fourth or fifth layer applied to one side of the support is difficult to process in 45 seconds as the development chemistry does not have enough time to develop the bottommost layers.

Further, the reflective imaging member is more curl resistant compared to prior art reflective silver halide image materials, as the light sensitive silver halide imaging layers dispersed in gelatin are applied to both sides of the transparent support. The ultraviolet and oxygen sensitive dyes can also be protected by the transparent polymer sheet, thus extending the life of the image. These and other advantages will be apparent from the detailed description below.

Figure 1:
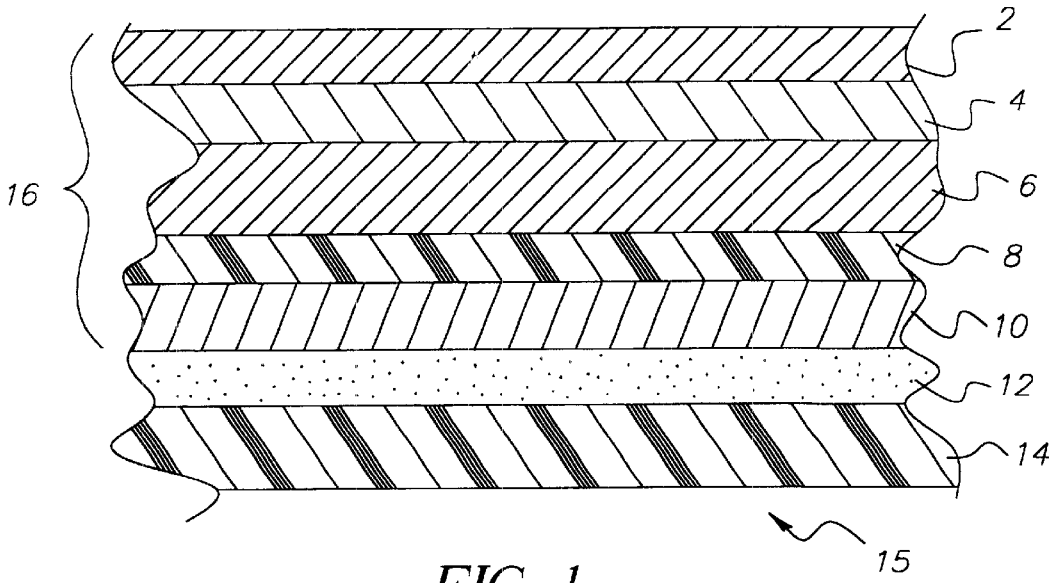
FIGS. 1–3 are cross-sectional views of photographic reflective imaging material with expanded color gamut.

Illustrated in FIG. 1 is a cross section of the reflective imaging element with expanded color gamut. Cyan dye formed image layer 2, magenta dye formed image layer 4, and yellow dye formed image layer 6 are located on top of transparent polymer support 8. On the back side of transparent polymer support 8 is located the red dye formed imaging layer 10. The image element 16 comprising layers attached to transparent support 8 are adhesively adhered to white reflective base 14 with pressure sensitive adhesive layer 12.

Figure 2:
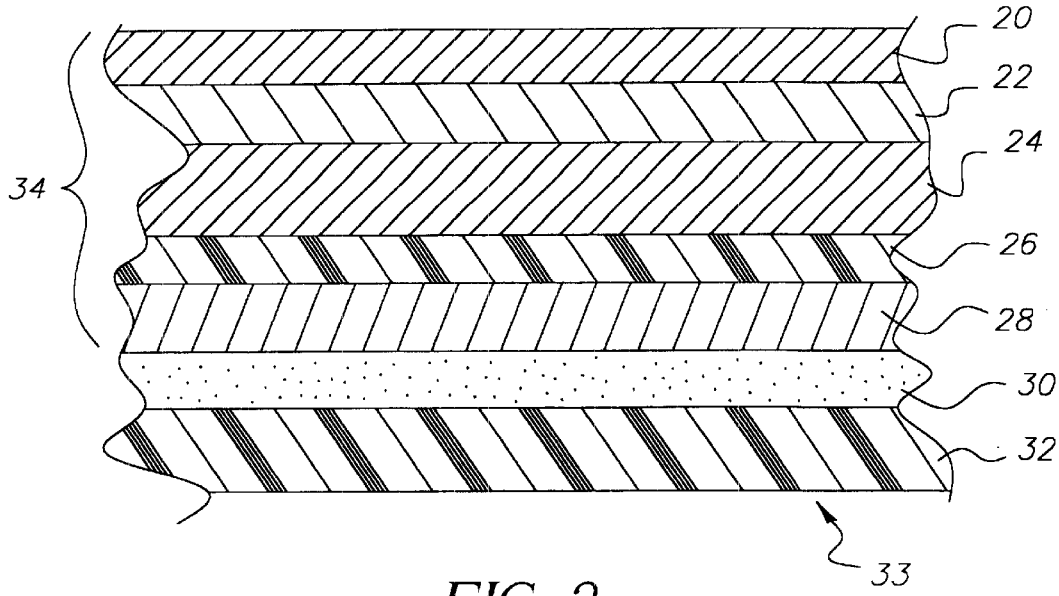

Illustrated in FIG. 2 is a cross section of the reflective imaging element 33 with expanded color gamut. Cyan dye formed image layer 20, magenta dye formed image layer 22, and yellow dye formed image layer 24 are located on top of transparent polymer support 26. On the back side of transparent support 26 is located the blue dye formed imaging layer 28. The image carrying element 34 comprising image layers attached to transparent support 34 is adhesively adhered to white reflective base 32 with pressure sensitive adhesive layer 30 to form element 3.

Figure 3:
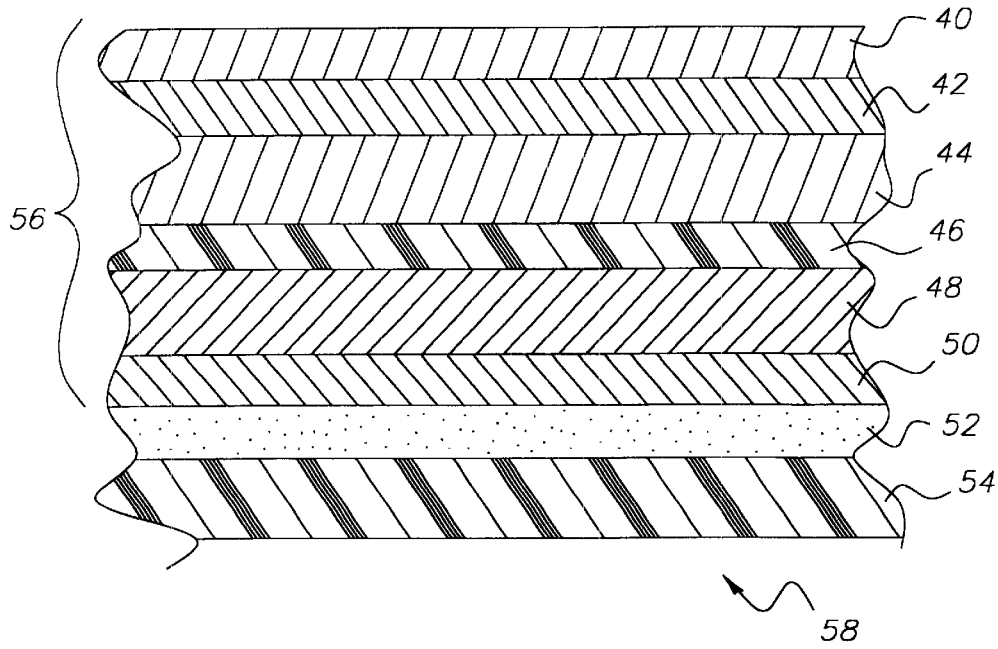

Illustrated in FIG. 3 is a cross section of the reflective imaging element with expanded color gamut. Cyan dye formed image layer 40, magenta dye formed image layer 42, and yellow dye formed image layer 44 are located on top of transparent support 46. On the back side of transparent support 46 is located the red dye formed imaging layer 48 and the blue dye formed image layer 50. The image element 56 comprising image layers attached to transparent support 56 is adhesively adhered to white reflective base 54 with pressure sensitive adhesive layer 52 to form element 58.

For the imaging elements of the invention, an imaging element comprises a transparent polymer sheet, and at least one photosensitive dye forming coupler containing layer is on each side of said sheet, wherein there are at least four separate photosensitive layers and the photosensitive layers comprise at least four dye forming couplers that form at least four spectrally distinct colors is preferred. By applying at least one of the photosensitive dye forming couplers containing layers on the opposite side of the transparent support, during the processing step of image creation, the additional layer of the invention is in contact with the development chemistry, thereby allowing for 45 second development time.

The imaging element wherein said at least four spectrally distinct colors comprise magenta, yellow, cyan, red and black, wherein said red has a CIELAB hue angle, $h_{ab}$, from not less than 355 to not more than 75 degrees is preferred. The possible combinations of cyan, magenta and yellow colorants limit the color saturation and color gamut of red, green and blue colors that a subtractive color photographic system can reproduce. We have found that the color gamut of a photographic system can be expanded by the use of additional colorants. Red in combination with magenta, yellow, cyan and black is preferred because red as defined as CIELAB hue angle, $h_{ab}$, from not less than 355 to not more than 75 degrees, improves color reproduction possible working in silver halide color space. The red improves a color deficiency in the current silver halide color space, thus allowing an improved color gamut, especially red. The black also provides additional density that is difficult to obtain using balanced amounts of yellow, magenta, and cyan providing a deeper, more saturated black. An improved black is more perceptually preferred compared to blacks created using balanced amounts of magenta, cyan, and yellow.

The imaging element wherein at least four spectrally distinct colors comprise magenta, yellow, cyan, blue and black, wherein said preferred blue has a CIELAB hue angle, $h_{ab}$, from 225 to 310 degrees. The possible combinations of cyan, magenta and yellow colorants limit the color saturation and color gamut of red, green, and blue colors that a subtractive color photographic system can reproduce. We have found that the color gamut of a photographic system can be expanded by the use of additional colorants. Blue, in combination with magenta, yellow, cyan, and black is preferred because blue as defined as CIELAB hue angle, $h_{ab}$, from 225 to 310 degrees improves color reproduction possible working in silver halide color space. The blue improves a color deficiency in the current silver halide color space, thus allowing an improved color gamut, especially in the blue. The black also provides additional density that is difficult to obtain using balanced amounts of yellow, magenta, and cyan providing a deeper, more saturated black. An improved black is more perceptually preferred compared to blacks created using balanced amounts of magenta, cyan, and yellow.

The imaging element wherein at least four spectrally distinct colors comprise magenta, yellow, cyan and red, wherein said preferred red has a CIELAB hue angle, $h_{ab}$, from not less than 355 to not more than 75 degrees. The possible combinations of cyan, magenta, and yellow colorants limit the color saturation and color gamut of red, green, and blue colors that a subtractive color photographic system can reproduce. We have found that the color gamut of a photographic system can be expanded by the use of additional colorants. Red, in combination with magenta, yellow, and cyan is preferred because red as defined as CIELAB hue angle, $h_{ab}$, from not less than 355 to not more than 75 degrees, improves color reproduction possible working in silver halide color space. The red improves a color deficiency in the current silver halide color space, thus allowing an improved color gamut, especially in the red.

One preferred imaging element has at least four spectrally distinct colors comprise magenta, yellow, cyan, and blue wherein the blue has a CIELAB hue angle, $h_{ab}$, from 225 to 310 degrees. The possible combinations of cyan, magenta, and yellow colorants limit the color saturation and color gamut of red, green, and blue colors that a subtractive color photographic system can reproduce. We have found that the color gamut of a photographic system can be expanded by the use of additional colorants. Blue, in combination with magenta, yellow, and cyan is preferred because blue as defined as CIELAB hue angle, $h_{ab}$, from 225 to 310 degrees improves color reproduction possible working in silver halide color space. The blue improves a color deficiency in the current silver halide color space, thus allowing an improved color gamut, especially in the blue.

In one preferred imaging element of the invention the spectrally distinct colors comprise magenta, yellow, cyan, red, and blue wherein said blue has a CIELAB hue angle, $h_{ab}$, from 225 to 310 degrees and wherein said red has a CIELAB hue angle, $h_{ab}$, from not less than 355 to not more than 75 degrees. The possible combinations of cyan, magenta, and yellow colorants limit the color saturation and color gamut of red, green, and blue colors that a subtractive color photographic system can reproduce. We have found that the color gamut of a photographic system can be expanded by the use of additional colorants. Blue and red in combination with magenta, yellow, and cyan is preferred because blue and red improves color reproduction possible working in silver halide color space. The blue and red improves a color deficiency in the current silver halide color space, thus allowing an improved color gamut of the image.

In another preferred imaging element of the invention the spectrally distinct colors comprise magenta, yellow, cyan, red, black, and blue, wherein said blue has a CIELAB hue angle, $h_{ab}$, from 225 to 310 degrees and wherein said red has a CIELAB hue angle, $h_{ab}$, from not less than 355 to not more than 75 degrees. The possible combinations of cyan, magenta, and yellow colorants limit the color saturation and color gamut of red, green, and blue colors that a subtractive color photographic system can reproduce. We have found that the color gamut of a photographic system can be expanded by the use of additional colorants. Blue, black, and red in combination with magenta, yellow, and cyan is preferred because blue and red improves color reproduction possible working in silver halide color space. The blue, black and red improves a color deficiency in the current silver halide color space, thus allowing an improved color gamut of the image. Further, by combining red, blue and black, the image not only has improved color gamut, but also the black provides additional density that is difficult to obtain using equal yellow, magenta and cyan providing a deeper, more saturated black. An improved black is more perceptually preferred compared to blacks created using equal amounts of magenta, cyan, and yellow.

The transparent polymer sheet of the invention preferably has an optical transmission greater than 90%, as the light sensitive silver halide imaging layers applied to both sides of the transparent polymer sheet are exposed simultaneously. Additionally, a transparent polymer base is preferred, as the images formed on the bottom side can be viewed through the polymer base. The term as used herein, "transparent" means the ability to pass radiation without significant deviation or absorption. For this invention, "transparent" material is defined as a material that has a spectral transmission greater than 90%. For a photographic element, spectral transmission is the ratio of the transmitted power to the incident power and is expressed as a percentage as follows; $T_{RGB}=10^{-D}*100$ where D is the average of the red, green and blue Status A transmission density response measured by an X-Rite model 310 (or comparable) photographic transmission densitometer.

A biaxially oriented transparent polymer sheet is preferred as biaxial orientation of a polymer increases the toughness and the ability to carry the light sensitive silver halide imaging layers though manufacturing and the imaging development process. Biaxially oriented polymer bases are conveniently manufactured by coextrusion of the base, which may contain several layers, followed by biaxial orientation. Such biaxially oriented bases are disclosed in, for example, U.S. Pat. Nos. 4,764,425 and 5,866,282.

Suitable classes of thermoplastic polymers for the biaxially oriented transparent polymer sheet include polyolefins, polyesters, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, polysulfonates, polyester ionomers, and polyolefin ionomers. Copolymers and/or mixtures of these polymers can be used.

Polyolefins, particularly polypropylene, polyethylene, polymethylpentene, and mixtures thereof are preferred for the transparent polymer sheet. Polyolefin copolymers, including copolymers of propylene and ethylene such as hexene, butene and octene are also preferred. Polypropylenes are most preferred polyolefin polymers because they are low in cost and have good strength and surface properties and are transparent after orientation.

Preferred polyesters for the transparent polymer sheet include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well-known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510.

Polyester is the most preferred polymer for use as a transparent polymer sheet because the polyester polymer is high in strength and is transparent after orientation. Further, polyester polymer has been found to have sufficient modulus to provide a photographic member that is low in curl and highly tear resistant providing an image that can withstand the rigors of consumer handling. Finally, polyester polymer has been shown to reduce the flow of oxygen and nitrogen which have been shown to catalyze the fading of color couplers.

Useful polyamides include for the transparent polymer sheet nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

The transparent polymer sheet preferably is provided with an integral emulsion adhesion layer to avoid the need for expensive primer and sub coatings known in the art to improve gelatin adhesion to polymer sheets. An example of a suitable integral emulsion adhesion layer is described in U.S. Pat. No. 5,866,282 (Bourdelais et al). The most preferred integral emulsion adhesion layer is a layer of polyethylene that is CDT treated prior to the coating of light sensitive silver halide imaging layers.

The polymer base is preferably supplied with a variety of coatings referred to hereon as shield layers, that will protect the polymer base from scratching, fingerprinting, and static. Suitable coatings include, but are not limited to, urethane polymer, silicates and waxes. The surface of the polymer base preferably is rough to create a stand-off between oils present in fingerprints and the polymer base. The preferred roughness average is between 0.20 and 3.0 micrometers. Below 0.18 micrometers, little improvement in fingerprint resistance is observed. Above 4.0 micrometers, the rough side of the polymer base beings to emboss the light sensitive silver halide layers when the light sensitive silver halide coated polymer base is wound in a roll.

The developed silver halide image layers preferably contain an environmental protection layer or EPL to protect the delicate silver halide formed image from handling damage and damage caused from exposure to liquids. Examples of liquids that can damage the silver halide formed image include water, coffee, soda, and the like. Preferred EPLs include UV curable polymers, latex, acrylic, and laminated polymer sheets. Because the EPL layer is critical to conveyance and forming in automated packaging equipment, the EPL layer may require modification. Packaging products commonly use a variety of lubricants to provide abrasion resistance and slip characteristics. Lubricants used in substrates, printing inks, and coatings include natural waxes, synthetic waxes, fatty acid amides, polytetrafluroroethylene (PTFE), as well as silicone-based compounds.

Natural waxes include vegetable waxes such as carnuba, candelilla, and ouricury. Carnuba, for example, has a molecular weight range of 340–820 with a melting point range of 80–86° C. It has a specific gravity similar to water. Animal and insect waxes include beeswax, shellac, and lanolin. Natural mineral waxes include montan and ozokerite. Natural petroleum waxes include paraffin and microcrystalline waxes. Montan is very similar to carnuba wax and has similar molecular weight and melting point characteristics.

Fatty acid amides include euricimide, stearamides, and other primary amides. Fatty acid amides behave like waxes. They have similar molecular weight ranges (275–350) and melting point ranges (68–108° C.).

Synthetic waxes used in packaging include Fisher-Tropsch waxes, PE and PP waxes, and PTFE. PE waxes are used extensively in inks and coatings. They improve abrasion resistance and easily disperse in most common solvents. PTFE waxes used in the ink and coating industries are chemically related to Teflon but have lower molecular weight (10,000–100,000). These waxes have melting points above 300° C. and specific gravity greater than 2. Because they have much higher specific gravity than other waxes, they can be more difficult to handle in low-viscosity systems, such as water-based inks and coatings.

PTFE waxes can be produced in particle sizes ranging from submicrometers to 20 $\mu$m. These particles are extremely hard, and the PTFE has lower surface tension than any of the comparable hydrocarbon-based waxes. Use of PTFE is very effective in reducing COF in printing inks and coatings. Since PTFEs do not dissolve or "bloom to the surface," they are effective in providing lower COF at press. PTFE is chemically inert. It is thermally and oxidatively stable to temperature of 320° C. It is UV-resistant and nonflammable, and it can be used as a release additive.

Silicon-based products are used extensively in inks and coatings to provide slip, abrasion, and mar resistance, as well as release characteristics. Although silicon-based products are used for many of the same purposes as waxes and PTFEs, they are different in performance. Silanes are used when clarity is a priority.

Particle size is a critical parameter for optimum performance of wax. The particle size best suited for given applications should be similar to the thickness of that application of the applied ink film. Lithography applies a very thin ink film in the range of 2–3 μm. Wax particles that are much higher than 5 μm will have difficulty passing through the nip, which may have a gap of only 6 μm. If larger particles are used, "piling" can occur. At the same time, if a coating is applied by rotogravure, the coating process can tolerate much higher particle size wax constituents. In general, for an ink film in the range of 3 μm, a particle size range of 4–6 μm offers the best compromise of rub resistance and performance.

Since the transparent polymer sheet is coated with silver halide imaging layers that are oxygen and moisture sensitive, the transparent sheet of the invention preferably contains oxygen and moisture barrier properties to improve, for example, gelatin hardening which depends the moisture gradient between the machine dryer and the gelatin imaging layers. The preferred water transmission rate of the transparent polymer sheet is between 5 and 500 grams/$m^2$/day utilizing test method ASTM F1249. Below 1 gram/$m^2$/day, expensive auxiliary coatings are required to reduce water transmission. Above 600 grams/$m^2$/day, little improvement in gelatin hardening has been observed. The preferred oxygen transmission rate of the transparent polymer sheet is between 2 and 120 cc/$m^2$/day utilizing test method D3985. Below 1 cc/$m^2$/day, expensive coatings are required to reduce the oxygen transmission rate. Above 150 cc/$m^2$/day, little improvement in dye fade, which is known in the art to be accelerated in the presence of oxygen, has been observed.

Another unique feature of this invention is the addition of an antihalation layer to the imaging layers. The antihalation layer prevents unwanted secondary exposure of the silver crystals in the imaging layer as light is absorbed in the antihalation layer during exposure. The prevention of secondary exposure of the light sensitive silver crystals will significantly increase the sharpness of the image and preserve the inherent dye hue of the couplers utilized in the invention without the use of $TiO_2$ which is commonly used in prior art reflective photographic print materials.

Surprisingly, it has also been found that polymer chemistry can be added to the biaxially oriented polymer sheet to provide ultraviolet protection to the color couplers used in the developed image layer. Traditionally, this protection for prior art materials has been provided in the gelatin overcoat layer. The incorporation of the ultraviolet protection materials in the biaxially oriented polymer sheet of this invention provides better ultraviolet protection to the imaging couplers and is lower in cost, as less ultraviolet filter materials are required in the biaxially oriented sheet than in a gelatin overcoat.

By printing and developing the images on the oriented polymer base, folding the imaged polymer base around a planar partitioning member and then adhering the imaged polymer base to the planar partitioning member, this invention avoids many of the problems associated with coating the light sensitive emulsions onto a photographic base containing cellulose paper. Problems that are avoided by applying the light sensitive silver halide layers to the oriented polymer include paper dusting during slitting and punching, edge penetration of processing chemicals into the exposed paper along the slit edge, and unwanted secondary reflection caused by the paper base. Further, for prior art photographic reflective print materials, great care must be taken to ensure that the paper base does not chemically sensitize the light sensitive image layers prior to processing. By joining the imaging layers with a reflective planar partitioning member after processing, the criticalities of the chemical sensitization of the base have been removed. Joining of the imaging layers of this invention with a reflective planar partitioning member after processing would allow many different types of planar partitioning members to be utilized, offering the consumer a wide range of options such as paper, polymer base, or fabric base that at present are not widely available. The technique is good for producing album pages when a suitable reflective planar practitioning member of album size is utilized.

Since the polymer base onto which the light sensitive silver halide layers are applied typically is thin, a white reflective sheet is required to provide stiffness to the image and provide reflective properties for viewing in ambient lighting conditions. A white reflective sheet that has a stiffness of at least 100 millinewtons is preferred as image stiffness less than 80 millinewtons has been shown to be perceived as low in quality as the consumer associates high quality with a stiff image. Stiffness between 100 millinewtons and 450 millinewtons is most preferred, as stiffness greater than 500 millinewtons is too stiff and encumbers viewing and storage of images by consumers especially in photographic albums and frames.

A white reflective sheet that has an L* greater than 92.0 is preferred, as white reflective sheets with L* less than 91.0 are not bright enough for a high quality reflective image. A white reflective sheet is preferred, as the white content or density minimum areas in an image are created by the whiteness of the base because silver halide imaging systems cannot as of yet create the color "white".

A white reflective sheet that has an opacity of at least 88 is preferred because two-sided images with a white reflective sheet with an opacity of less than 85 will create image interference, as the images are viewed when back lighting is present as is the case when images are viewed in front of a sunlit window. A spectral transmission of the white reflective sheet of less than 15% is preferred, as spectral transmission above 20% would result in a loss in image quality as ambient light would show the back logo as images are viewed by consumers.

The white reflective sheet preferably comprises cellulose paper. Cellulose paper is preferred as cellulose paper is low in cost compared to polymer alternatives. Further, cellulose paper is light in weight and has acceptable opacity as the air voids in a cellulose paper sheet provide opacity without the expensive need for white pigments such as $TiO_2$ and calcium carbonate. Examples of suitable cellulose papers for a white reflective sheet are those disclosed in U.S. Pat. Nos. 5,244,861; 5,866,282; 5,290,672; and 5,466,519.

Another preferred white reflective sheet comprises a polymer. A polymer white reflective sheet is typically smooth resulting in a high quality glossy image. Further, addenda may be added to the polymer white reflective sheet to improve the sharpness and whiteness of the image and the opacity of the photographic member. Addenda such as white pigments to improve the density minimum areas of the image, optical brightener to prove a blue tint to the density minimum areas and blue tint to off set the native yellowness of the gelatin utilized in the silver halide imaging members. Examples of suitable polymers for a white reflective sheet are those disclosed in U.S. Pat. Nos. 4,912,333; 4,994,312; 5,055,371; and 4,187,133. Voided polyester white reflective sheets are preferred, as white pigment content in polyester can approach 70% by weight of polymer producing a exceptionally white density minimum area. Voided polyolefin sheets are preferred, as they tend to be low in cost and high in mechanical modulus which results in a stiff photograph.

The white reflective sheet preferably comprises a composite structure that includes both a cellulose paper and polymer coatings and/or sheets applied to the surface of the cellulose paper. A composite structure consisting of a cellulose paper base and a polymer for the white reflective sheet allows for a low cost, high quality, white reflective sheet as this combination allows for the use of low cost of cellulose paper to be used in combination with the desirable performance characteristics of a polymer coating or sheet. Examples of suitable cellulose paper, polymer combinations for a white reflective sheet are those disclosed in U.S. Pat. Nos. 5,866,282; 5,874,205; 5,888,681; and 5,466,519.

Additionally, a two-sided image with expanded color gamut can be created by exposing and developing an image on a polymer base. After development a 180 degree fold is created at every other developed image. After the 180 degree fold, the white reflective sheet is inserted between the folded images and adhered on both sides to the imaging layers. The fold may be created by techniques known in the packaging art to create folds in polymer materials. Another preferred method for the folding of the developed photographic image is around the white reflective sheet. The developed image on the polymer base is folded around one edge of the white reflective sheet and subsequently adhered to the white reflective sheet.

To adhere the transparent sheet with the developed image layers to the white reflective sheet, a bonding layer is required. The bonding layer must provide excellent adhesion between the imaging layers and the white reflective sheet for the useful life of the image. The preferred method of adhering the imaging layers and white reflective sheet is by use of an adhesive. The adhesive preferably is coated or applied to the white reflective sheet. The adhesive preferably is a pressure sensitive adhesive or heat activated adhesive. During the bonding process, the imaging layers is adhered to the white reflective sheet by use of a nip roller or a heated nip roll in the case of a heat activated adhesive. A preferred pressure sensitive adhesive is an acrylic based adhesive. Acrylic adhesives have been shown to provide an excellent bond between gelatin developed imaging layers and biaxially oriented polymer base sheets.

The preferred thickness of the adhesive layer is between 2 and 40 micrometers. Below 1 micrometer, uniformity of the adhesive is difficult to maintain leading to undesirable coating skips. Above 45 micrometers, little improvement in adhesion and coating quality is observed and, therefore, increased adhesive is not cost justified. An important property of the adhesion layer between the developed silver halide imaging layers and the white reflective sheet is the optical transmission of the adhesive layer. A laminated adhesive layer with an optical transmission greater than 90% is preferred, as the adhesive should not interfere with the quality of the image.

The CIELAB metrics, a*, b*, and L*, when specified in combination, describe the color of an object, (under fixed viewing conditions, etc). The measurement of a*, b*, and L* are well documented and now represent an international standard of color measurement. (The well-known CIE system of color measurement was established by the International Commission on Illumination in 1931 and was further revised in 1971. For a more complete description of color measurement, refer to "Principles of Color Technology, 2nd Edition by F. Billmeyer, Jr. and M. Saltzman, published by J. Wiley and Sons, 1981).

L* is a measure of how light or dark a color is. L*=100 is white. L*=0 is black. The value of L* is a function of the Tristimulus value Y, thus $$L^*=116(Y/Y_n)^{1/3}-16$$

Simply stated, a* is a measure of how green or magenta the color is (since they are color opposites), and b* is a measure of how blue or yellow a color is. From a mathematical perspective, a* and b* are determined as follows:

$$a^*=500\{(X/X_n)^{1/3}-(Y/Y_n)^{1/3}\}$$

$$b^*=200\{(Y/Y_n)^{1/3}-(Z/Z_n)^{1/3}\}$$

where X, Y, and Z are the Tristimulus values obtained from the combination of the visible reflectance spectrum of the object, the illuminant source (i.e. 5000° K), and the standard observer function.

The a* and b* functions determined above may also be used to better define the color of an object. By calculating the arctangent of the ratio of b*/a*, the hue-angle of the specific color can be stated in degrees.

$$h_{ab}=\arctan(b^*/a^*)$$

The nomenclature convention for this definition differs from that of the geographic compass heading where 0° or 360° represents north and the angle increases in a clockwise direction. As defined in colorimetric usage, the 0° hue angle is the geographic equivalent of 90° or east, and hue angle increases in a counterclockwise direction. A hue-angle of 0° is broadly defined as magenta. It's complement, 180°, as green. The hue-angle compass between 0° and 360° then includes and describes the hue of all colors. Hue angle does not define lightness or darkness, which is defined by L*; nor color saturation, C* which is defined as $$C^*=(a^{*2}+b^{*2})^{1/2}$$

While it may be convenient to refer to a color as a specific color, for example, 'red', in reality, the perception of 'red' may encompass a range of hue-angles. This is also true for any other color. In color photographic systems, it is convenient to form cyan, magenta and yellow dyes as the primary subtractive dye set. Subsequently, to reproduce, for example, 'red', various combinations of yellow and magenta dyes are formed and the combination of these colorants is perceived by the viewer as 'red'. Similarly, to form 'blue', combinations of magenta and cyan dyes are formed, and to form 'green', combinations of cyan and yellow dyes are formed.

For example, a 'red' color formed by combining magenta and yellow dyes is limited to the color saturation C*, of the combination of magenta and yellow. As the relative ratios of the two dyes is varied, the hue angle of the combination changes in proportion. As the amounts of the two dyes change, the color saturation, C*, and the lightness L* change. The color saturation, also referred to as color purity is limited by the inherent spectral characteristics of the combinant dyes. The color saturation is a function of the shape of the adsorption band of each dye, the λ-max of each dye, the bandwidth of each dye and other system related factors such as the image viewing conditions, the color and lightness, L*, of the reflective support and many related other factors.

The possible combinations of cyan, magenta and yellow colorants then limit the color saturation and color gamut of red, green, and blue colors that a subtractive color photographic system can reproduce.

We have found that the color gamut of a photographic system can be expanded by the use of additional colorants. Preferred additional colorants are dyes that appear red, blue or black in color. The red or blue dyes are formed from couplers that have a chemical composition that produces dyes that appear blue or red. Dyes formed by red dye forming couplers have adsorption maxima between that of the magenta and yellow dyes; typically around 500 nm. Dyes formed by blue dye forming couplers have adsorption maxima between that of the magenta and cyan dyes; typically around 600 nm.

Surprisingly, the addition of a green colorant does not significantly increase the color gamut beyond the addition of the red, blue and black colorants.

In some C,M,Y printing systems, such as ink-jet or lithographic printing, a $4^{th}$ colorant, K, is added. The $4^{th}$ colorant is black and, therefore, by definition, cannot change the color or hue-angle of a color to which it has been added. The addition of black to a color has two effects: The first to darken the color, thus reducing its L* value and the second to desaturate the color (lower C*) which gives the impression that it is less pure.

The addition of K as a colorant has a small positive effect on the available color gamut as it makes dark colors (low L*) more easily achieved.

As used herein, the color gamut of a colorant set is the sum total of the nine slices of color space represented as the sum of a*×b* areas of 9-L* slices (L*=10, 20, 30, 40, 50, 60, 70, 80, and 90) for the dye set being tested. Color gamut may be obtained through measurement and estimation from a large sample of color patches (very tedious and time-consuming) or, as herein, calculated from the measured and blue absorption characteristics of the individual colorants using the techniques described in J. Photographic Science, 38, 163 (1990).

The absorption characteristics of a given colorant will vary to some extent with a change in colorant amount (transferred and blue density). This is due to factors such as a measurement flare, colorant-colorant interactions, colorant-receiver interactions, colorant concentration effects, and the presence of color impurities in the media. However, by using characteristic vector analysis (sometimes refereed to as principal component analysis or eigen-vector analysis), one can determine a characteristic absorption curve that is representative of the absorption characteristics of the colorant over the complete wavelength and density ranges of interest. The characteristic vector for each colorant is, thus, a two-dimensional array of optical transmission density and wavelength. This technique is described by Albert J. Sant in Photographic Science and Engineering, 5(3), May–June 1961 and by J. L. Simonds in the Journal of the Optical Society of America, 53(8), 968–974 (1963).

The characteristic vector for each colorant is a two-dimensional array of optical transmission density and wavelength normalized to a peak height of 1.0. The characteristic vector is obtained by first measuring the reflection spectra of test images comprising patches of varying densities of the colorant, including fully exposed development yielding a Dmax and no exposure (Dmin). The spectral reflection density of the Dmin is then subtracted from the spectral reflection density of each color patch. The resulting Dmin subtracted reflection densities are then converted to transmission density by passing the density data through the Dr/Dt curve as defined by Clapper and Williams, J. Opt. Soc. Am., 43, 595 (1953). Characteristic vector analysis is then used to find one transmission density curve for each colorant which, when scaled in transmission density space, converted to reflection density, and added to the Dmin of the reflection element, gives a best fit to the measured and blue spectral reflectance data. This characteristic vector is used herein to both specify the spectral absorption characteristics of the colorant and to calculate the color gamut of each imaging system employing the colorant.

Imaging couplers are nominally termed yellow, magenta and cyan if the spectra of their dyes generally absorb in the ranges of 400–500 nm, 500–600 nm, and 600–700 nm, respectively. The image dye-forming couplers in a given color record, typically comprised of one or more light sensitive silver halide emulsion layers, produce image dyes of similar spectral absorption (e.g $\lambda_{max}$+20 nm). Image dye-forming couplers are sufficient in type and coverage, considering all of the layers of a given color record, to provide a Dmax of at least 1.0. They may thereby be distinguished from functional PUG (photographically useful group) releasing couplers as known in the art, which form a very small portion of the resulting image dye. Thus, after coupling with oxidized developer, the image dye-forming couplers form a predominant portion of the image dye of a particular color record at maximum density. An imaging layer or layer(s) is a layer that is sensitized to light of a particular color range, suitably at least 30 nm apart from such layers sensitized to other color ranges. The absorption curve shape of a colorant is a function of many factors and is not merely a result of the selection of a particular colorant compound. The couplers conventionally employed in silver halide photography form dyes that include yellow ($h_{ab}$= 80–100°); cyan ($h_{ab}$=200–220°); magenta ($h_{ab}$=320–350°). Further, the spectral curve may represent the composite absorbance of two or more compounds. For example, if one particular compound provides the desired spectral curve, the addition of further compounds of the same color may provide a composite curve, which remains within the desired range. Thus, when two or more dyes of a particular color are employed, the spectral curve for the "magenta", "yellow", "blue", "red", or "cyan" colorant, for purposes of this invention, means the composite curve obtained from these two or more colorants.

Besides the chemical constitution of the dyes, the spectral curve of a given dye can be affected by other system components (solvents, surfactants, etc.). These parameters are selected to provide the desired spectral curve.

As noted above, the red dye forming coupler forms a dye that has a hue-angle, $h_{ab}$, of not less than 355° and not more than 75°, and the blue coupler forms a dye that has a hue-angle from 225 to 310°. The dyes are formed upon reaction of the coupler with a suitable developing agent such as a p-phenylenediamine color developing agent. Suitably, the agent is CD-3 as disclosed for use in the RA-4 process of Eastman Kodak Company as described in the British Journal of Photography Annual of 1988, pp 198–199 and described in detail below.

The hue angle of the red dye is from not less than 355° to not more than 75°, suitably from 5–75°, and preferably from 15–75°, and in this coupler combination, desirably from 25–45°.

Examples of 'red' dyes useful in the invention are:
IR-1
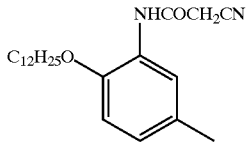
IR-2
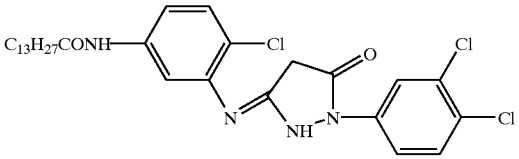
IR-3
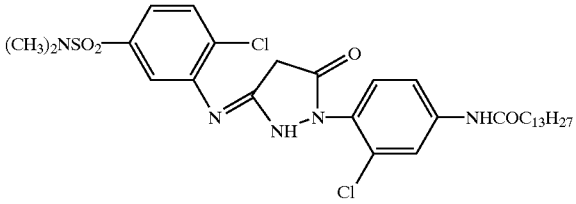
IR-4
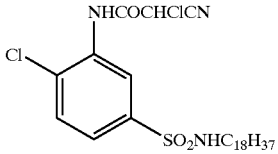
IR-5
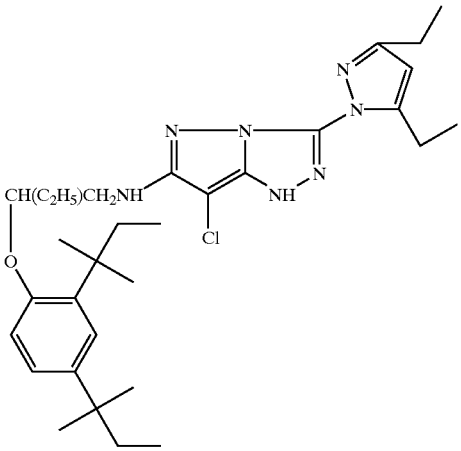
-continued
IR-6
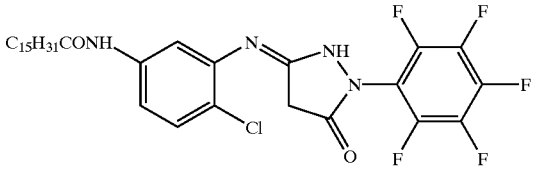
IR-7
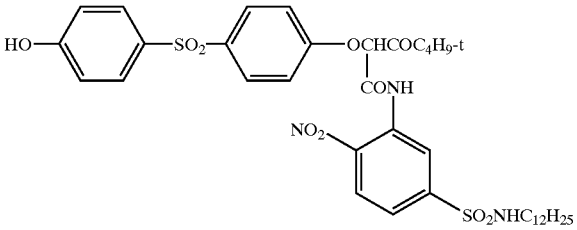
IR-8
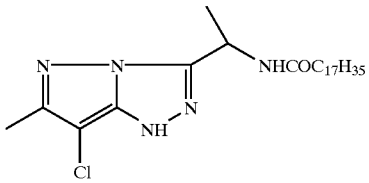
IR-9
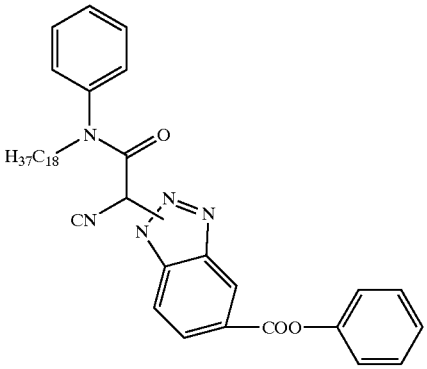
The hue angle of the blue dye is from 225 to 310°, suitably from 228–305°, and preferably from 230–290°. Examples of blue dyes useful in the invention are:
IB-1
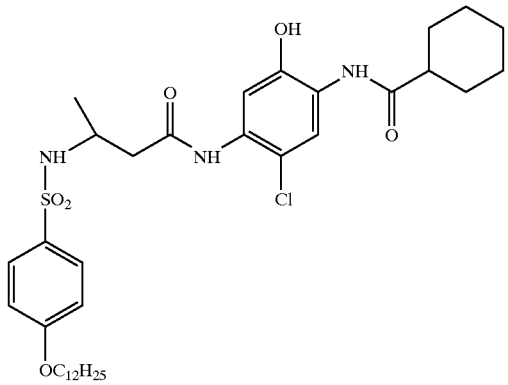

-continued

IB-2

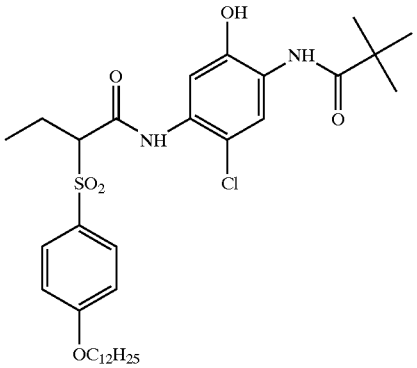

IB-3

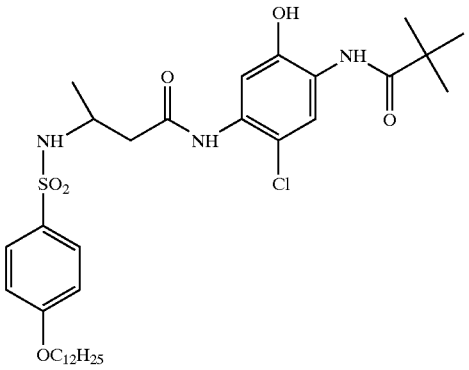

IB-4

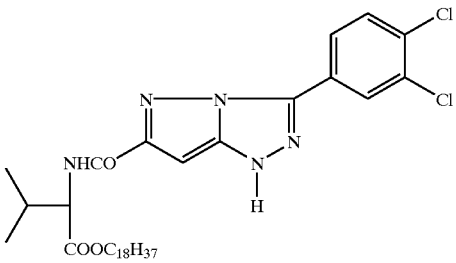

IB-5

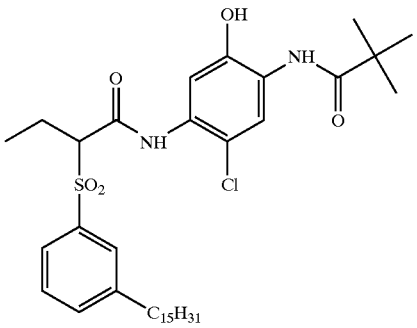

-continued

IB-6

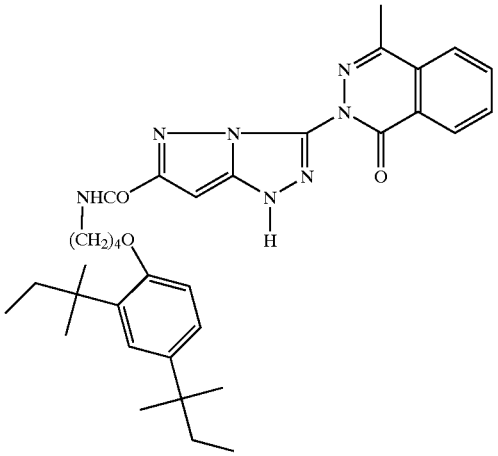

Since the effect of the red and blue dye-forming couplers of the invention is optical rather than chemical, the invention is not limited to a particular compound or class of compounds. Further, more than one coupler of a particular color may be employed in combination which together produce a composite density curve which may satisfy the requirements of the invention.

Black Image Couplers

Black image dye forming couplers are well known in the art. Black dyes are those which lack any specific recognizable color and appear as various shades of gray. They are generally formed from m- or p-aminophenols (U.S. Pat. No. 3,622,629); hydroxypyrazoles (U.S. Pat. No. 2,333,106); or resorcinols (U.S. Pat. Nos. 4,126,461 and 5,821,039. The dye is formed upon reaction with a suitable developing agent such as a p-phenylenediamine color-developing agent. Suitably the agent is CD-3,4-amino-3-methyl-N-ethyl-N-(2-methanesulfonamido-ethyl)aniline sesquisulfate hydrate, as disclosed for use in the RA-4 process of Eastman Kodak Company as described in the British Journal of Photography Annual of 1988, pp. 198–199.

Examples of resorcinol based black dye forming couplers particularly useful in the invention are in issued patents: Suitable black dye forming couplers are disclosed in U.S. Pat. No. 4,126,461 at columns 6–14. The black dye forming couplers in U.S. Pat. No. 5,821,039 at columns 3–5 compounds also are suitable.

It is also possible to have a black dye forming layer that consists of a mixture of cyan, magenta and yellow dyes. Preferred combinations of dye mixtures are given in U.S. Pat. Nos. 5,362,616; 5,364,747; and 5,939,247. The emulsions associated with a black dye forming layer can be singly, ortho- or pan-spectrally sensitized.

Cyan Image Couplers

The cyan coupler forms a dye that generally absorbs in the range between 600 nm and 700 nm. The dye is formed upon reaction with a suitable developing agent such as a p-phenylenediamine color-developing agent. Suitably the agent is CD-3,4-amino-3-methyl-N-ethyl-N-(2-methanesulfonamido-ethyl)aniline sesquisulfate hydrate, as disclosed for use in the RA-4 process of Eastman Kodak Company as described in the British Journal of Photography Annual of 1988, pp. 198–199.

(I)

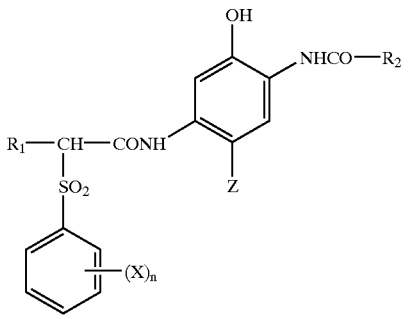

wherein $R_1$ represents hydrogen or an alkyl group;

$R_2$ represents an alkyl group or an aryl group;

n represents 1, 2, or 3;

each X is a substituent; and

Z represents a hydrogen atom or a group which can be split off by the reaction of the coupler with an oxidized color developing agent.

Coupler (I) is a 2,5-diacylaminophenol cyan coupler in which the 5-acylamino moiety is an amide of a carboxylic acid which is substituted in the alpha position by a particular sulfone (—$SO_2$—) group. The sulfone moiety is an arylsulfone. In addition, the 2-acylamino moiety must be an amide (—NHCO—) of a carboxylic acid, and cannot be a ureido (—NHCONH—) group. The result of this unique combination of sulfone-containing amide group at the 5-position and amide group at the 2-position is a class of cyan dye-forming couplers which form H-aggregated image dyes having very sharp-cutting dye hues on the short wavelength side of the absorption curves and absorption maxima (λmax) generally in the range of 620–645 nanometers, which is ideally suited for producing excellent color reproduction and high color saturation in color photographic papers.

Referring to formula (I), $R_1$ represents hydrogen or an alkyl group including linear or branched cyclic or acyclic alkyl group of 1 to 10 carbon atoms, suitably a methyl, ethyl, n-propyl, isopropyl or butyl group, and most suitably an ethyl group.

$R_2$ represents an aryl group or an alkyl group such as a perfluoroalkyl group. Such alkyl groups typically have 1 to 20 carbon atoms, usually 1 to 4 carbon atoms, and include groups such as methyl, propyl, and dodecyl; a perfluoroalkyl group having 1 to 20 carbon atoms, typically 3 to 8 carbon atoms, such as trifluoromethyl or perfluorotetradecyl, heptafluoropropyl or heptadecylfluorooctyl; a substituted or unsubstituted aryl group typically having 6 to 30 carbon atoms, which may be substituted by, for example, 1 to 4 halogen atoms, a cyano group, a carbonyl group, a carbonamido group, a sulfonamido group, a carboxy group, a sulfo group, an alkyl group, an aryl group, an alkoxy group, an aryloxy group, an alkylthio group, an arylthio group, an alkylsulfonyl group or an arylsulfonyl group. Suitably, $R_2$ represents a heptafluoropropyl group, a 4-chlorophenyl group, a 3,4-dichlorophenyl group, a 4-cyanophenyl group, a 3-chloro-4-cyanophenyl group, a pentafluorophenyl group, a 4-carbonamidophenyl group, a 4-sulfonamidophenyl group, or an alkylsulfonylphenyl group.

Examples of a suitable X substituent is one located at a position of the phenyl ring meta or para to the sulfonyl group and is independently selected from the group consisting of alkyl, alkenyl, alkoxy, aryloxy, acyloxy, acylamino, sulfonyloxy, sulfamoylamino, sulfonamido, ureido, oxycarbonyl, oxycarbonylamino, and carbamoyl groups.

In formula (I), each X is preferably located at the meta or para position of the phenyl ring, and each independently represents a linear or branched, saturated or unsaturated alkyl or alkenyl group such as methyl, t-butyl, dodecyl, pentadecyl or octadecyl; an alkoxy group such as methoxy, t-butoxy or tetradecyloxy; an aryloxy group such as phenoxy, 4-t-butylphenoxy or 4-dodecylphenoxy; an alkyl or aryl acyloxy group such as acetoxy or dodecanoyloxy; an alkyl or aryl acylamino group such as acetamido, benzamido, or hexadecanamido; an alkyl or aryl sulfonyloxy group such as methylsulfonyloxy, dodecylsulfonyloxy, or 4-methylphenylsulfonyloxy; an alkyl or aryl sulfamoylamino group such as N-butylsulfamoylamino, or N-4-t-butylphenylsulfamoylamino; an alkyl or aryl sulfonamido group such as methanesulfonamido, 4-chlorophenylsulfonamido or hexadecanesulfonamido; a ureido group such as methylureido or phenylureido; an alkoxycarbonyl or aryloxycarbonylamino group such as methoxycarbonylamino or phenoxycarbonylamo; a carbamoyl group such as N-butylcarbamoyl or N-methyl-N-dodecylcarbamoyl; or a perfluoroalkyl group such as trifluoromethyl or heptafluoropropyl. Suitably X represents the above groups having 1 to 30 carbon atoms, more preferably 8 to 20 linear carbon atoms. Most typically, X represents a linear alkyl or alkoxy group of 12 to 18 carbon atoms such as dodecyl, dodecyloxy, pentadecyl, or octadecyl.

"n" represents 1, 2, or 3; if n is 2 or 3, then the substituents X may be the same or different.

Z represents a hydrogen atom or a group which can be split off by the reaction of the coupler with an oxidized color developing agent, known in the photographic art as a "coupling-off group". The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclyl, sulfonamido, heterocyclylthio, benzothiazolyl, phosophonyloxy, alkylthio, arylthio, and arylazo. These coupling-off groups are described in the art, for example, in U.S. Pat. Nos. 2,455,169; 3,227,551; 3,432,521; 3,467,563; 3,617,291; 3,880,661; 4,052,212; and 4,134,766; and in U.K. Patent Nos. and published applications 1,466,728; 1,531,927; 1,533,039; 2,066,755A, and 2,017,704A. Halogen, alkoxy and aryloxy groups are most suitable.

Examples of specific coupling-off groups are —Cl, —F, —Br, —SCN, —$OCH_3$, —OC6$H_5$, —$OCH_2C(=O)NHCH_2CH_2OH$, —$OCH_2C(O)NHCH_2CH_2OCH_3$, —$OCH_2C(O)NHCH_2CH_2OC(=O)OCH_3$, —$P(=O)(OC_2H_5)_2$, —$SCH_2CH_2COOH$,

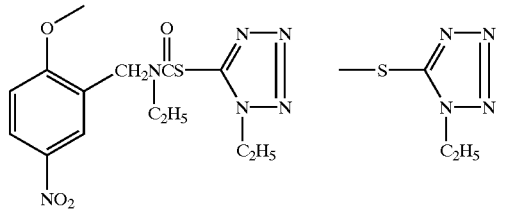

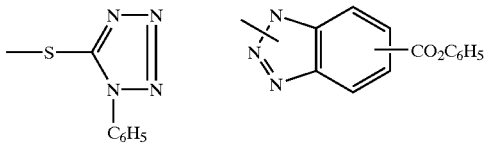

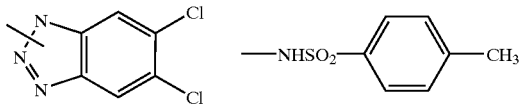

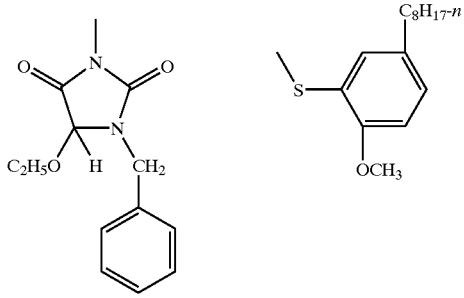

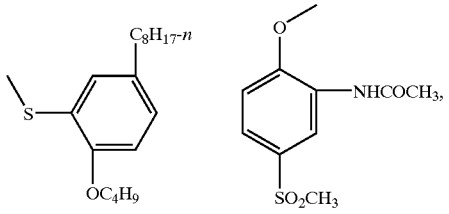

and

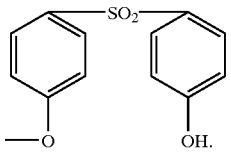

Typically, the coupling-off group is a chlorine atom.

It is essential that the substituent groups of the coupler be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus the combination of substituent groups in formula (I) are suitably chosen to meet these criteria. To be effective, the ballast must contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group. Therefore, in these embodiments the ballast would be primarily located as part of groups $R_2$, X, and Z. Furthermore, even if the coupling-off group Z contains a ballast it is often necessary to ballast the other substituents as well, since Z is eliminated from the molecule upon coupling; thus, the ballast is most advantageously provided as part of groups $R_2$ and X.

The following examples illustrate cyan couplers useful in the invention. It is not to be construed that the present invention is limited to these examples.

C-1

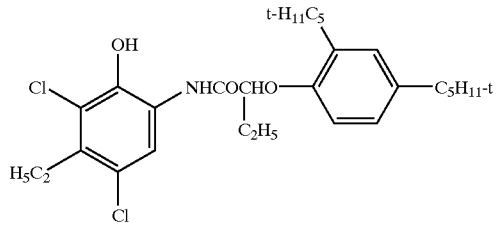

C-2

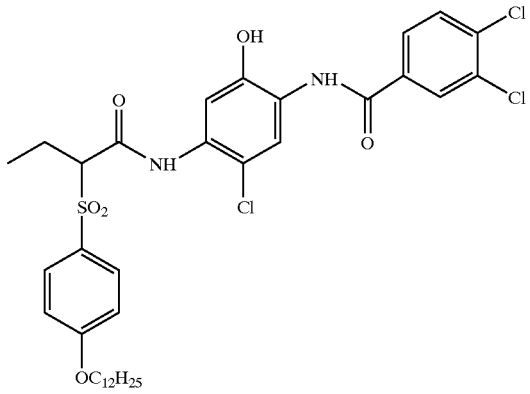

C-3

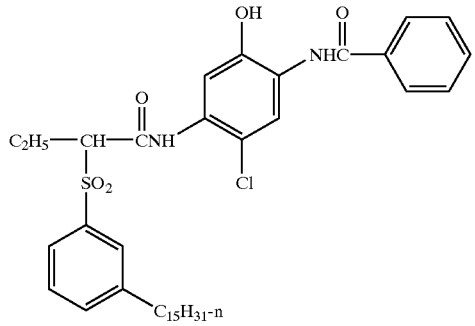

C-4

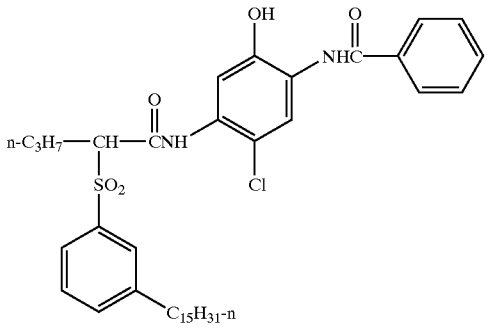

-continued
C-5
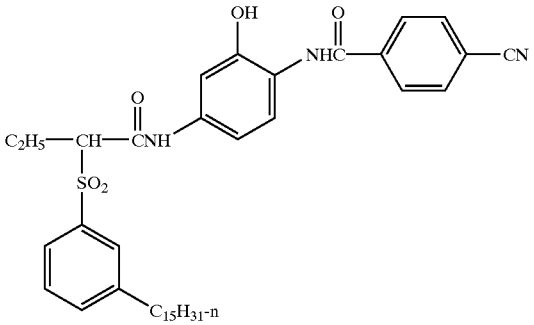
C-6
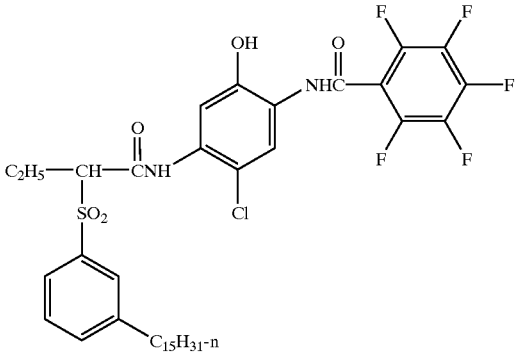
C-7
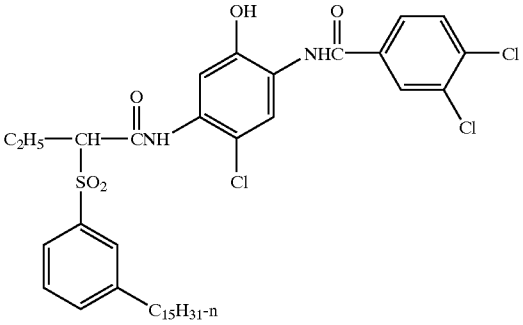
C-8
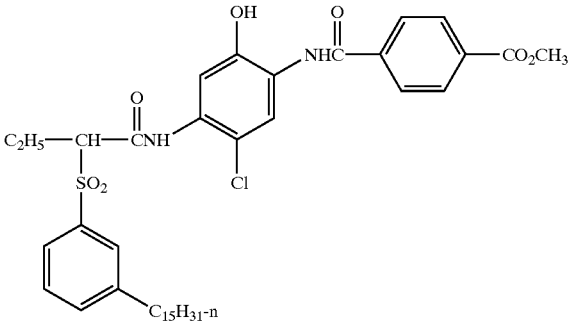
-continued
C-9
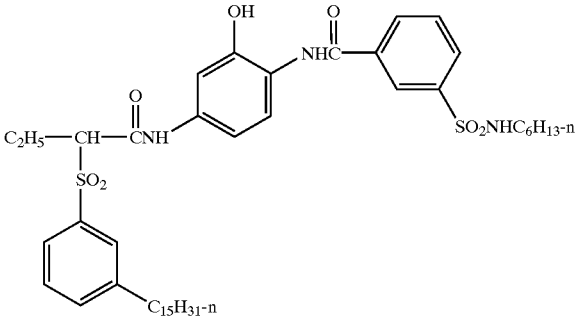
C-10
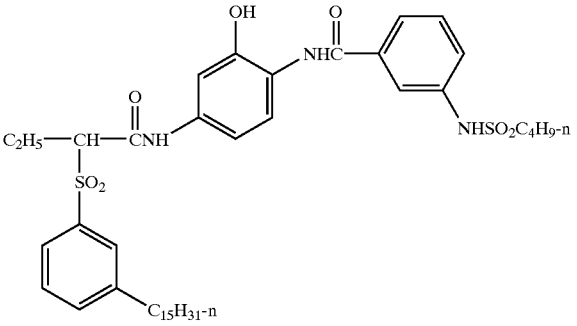
C-11
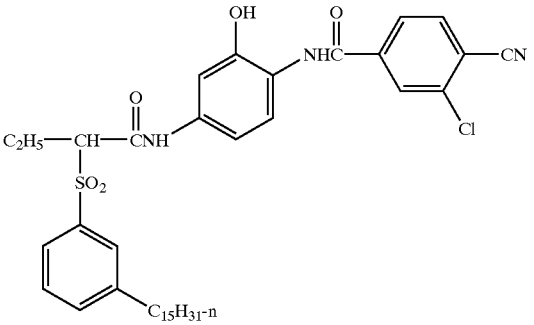
C-12
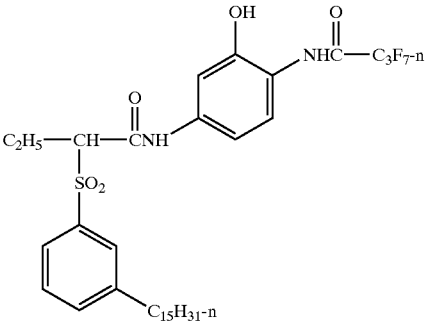

-continued
C-13
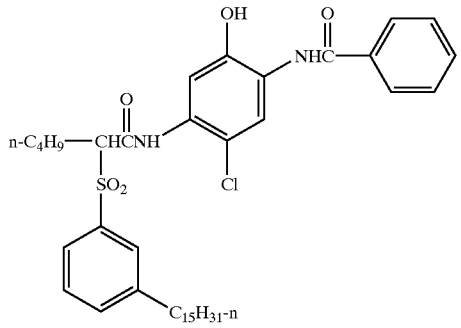
C-14
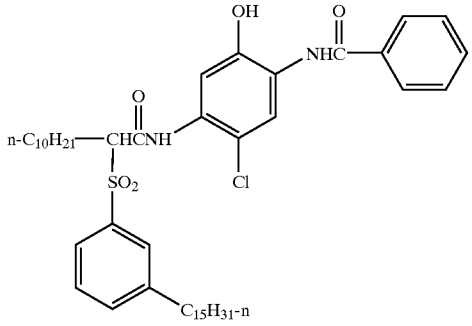
C-15
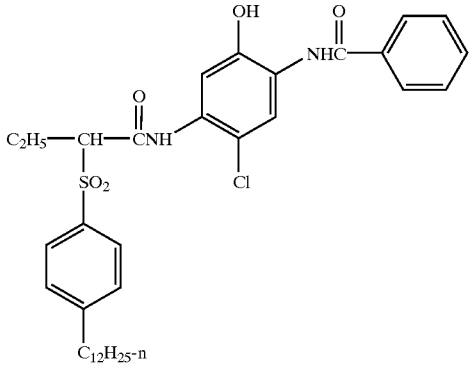
C-16
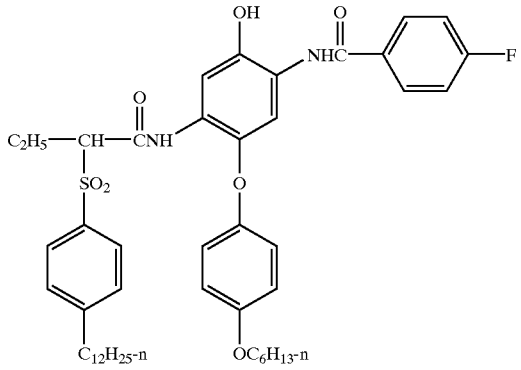
-continued
C-17
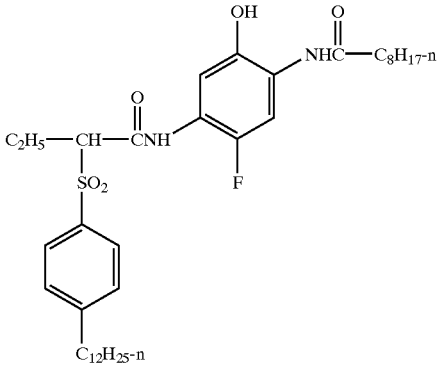
C-18
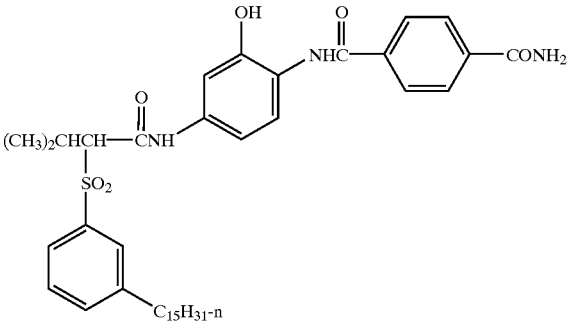
C-19
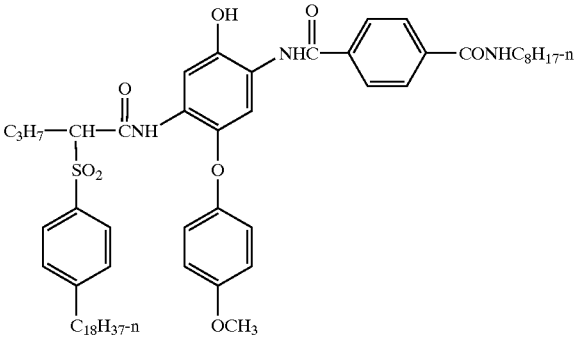
C-20
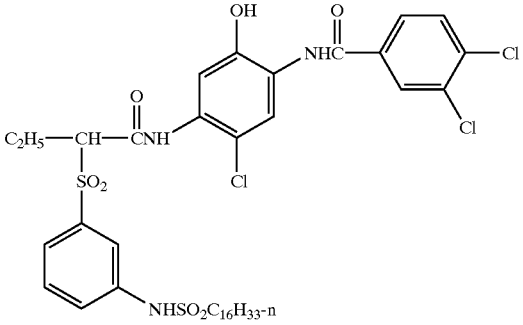

-continued
C-21
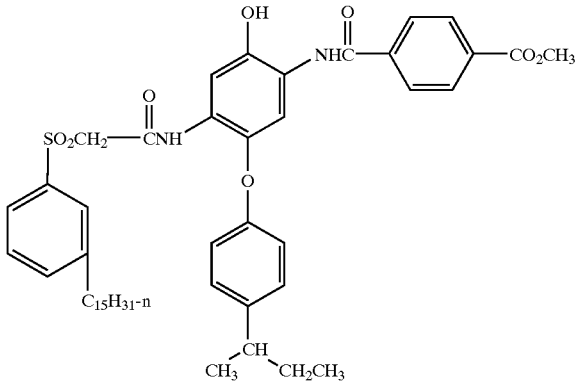
C-22
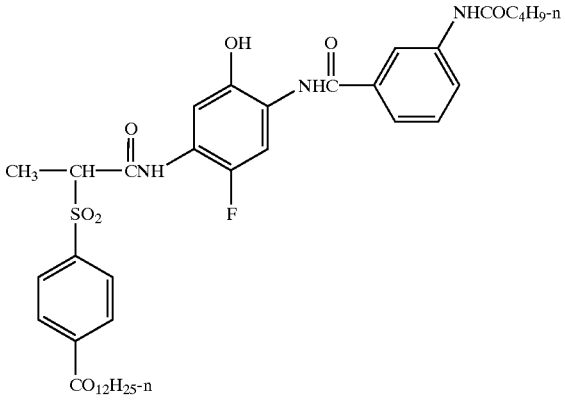
C-23
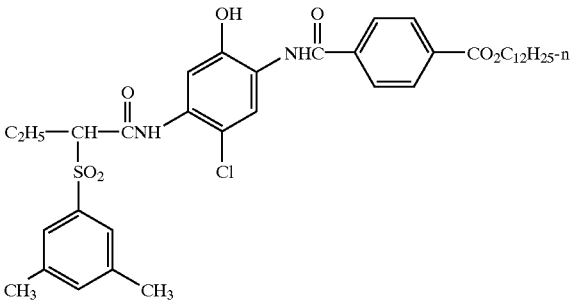
C-24
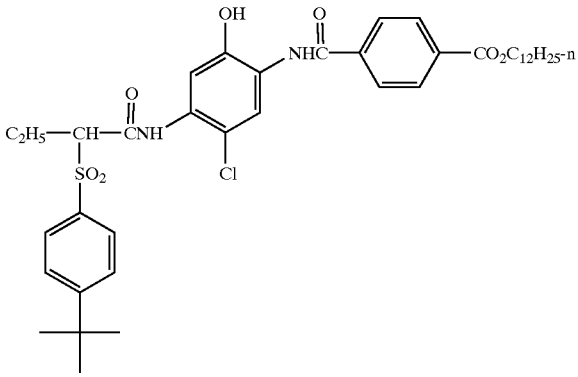
-continued
C-25
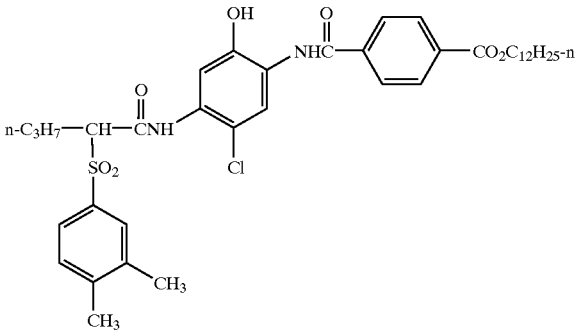
C-26
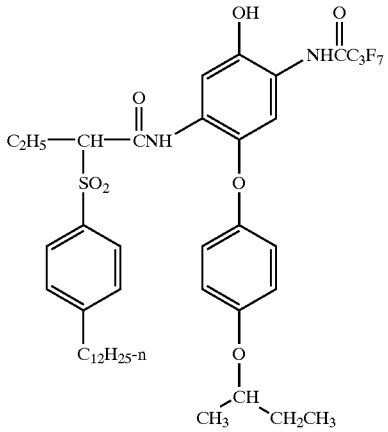
C-27
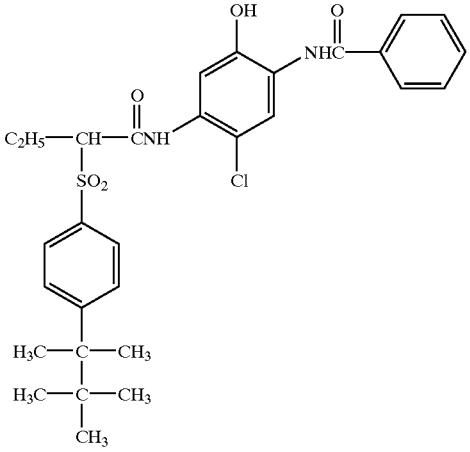
C-28
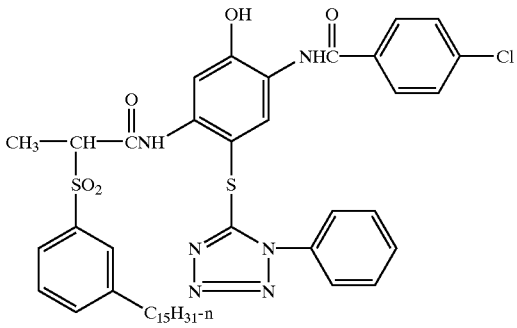

-continued
C-29
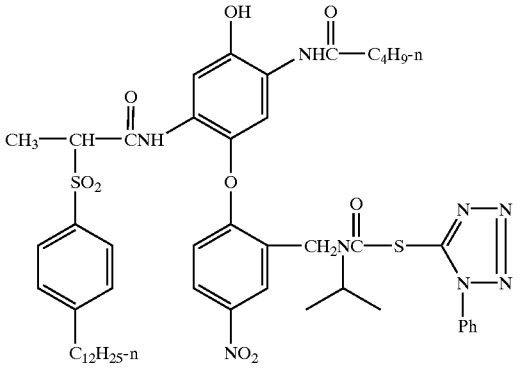
C-30
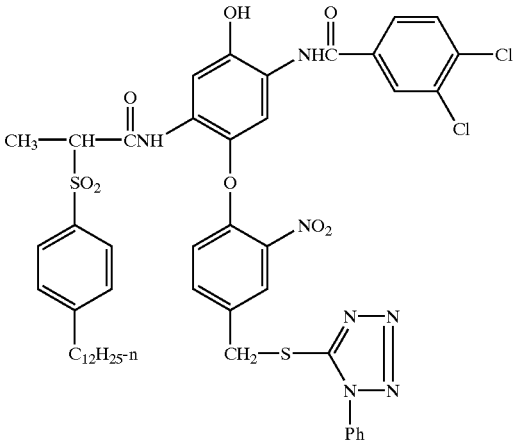
C-31
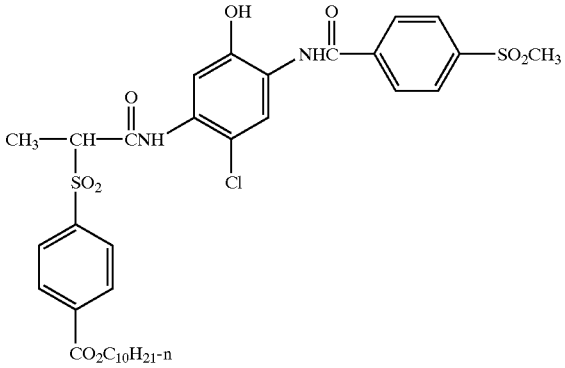
C-32
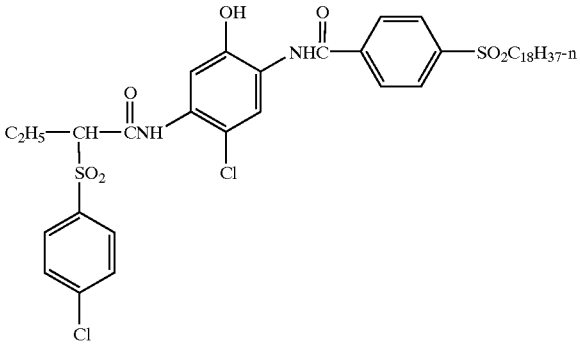
-continued
C-33
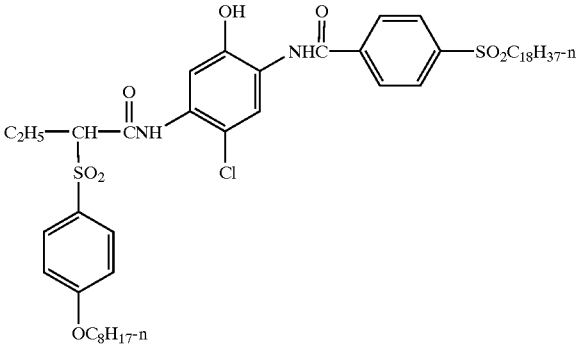
C-34
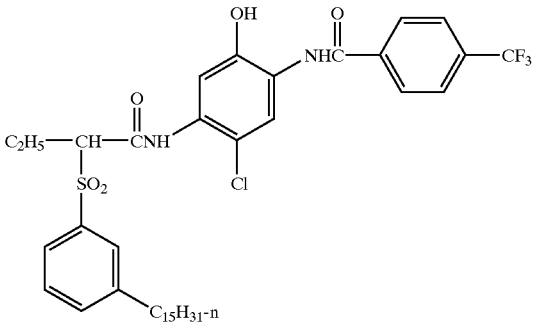
C-35
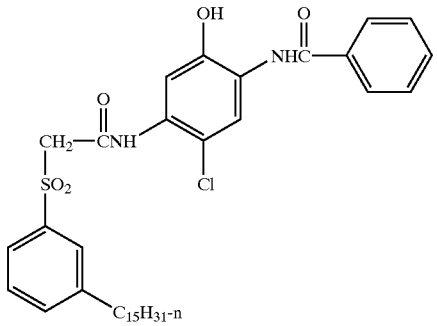
C-36
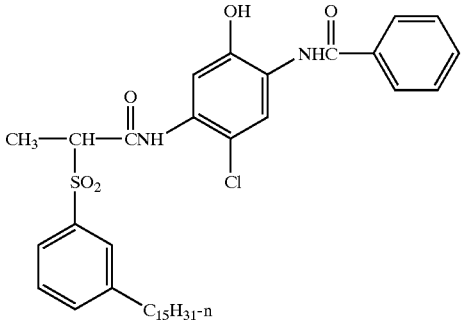
Magenta Image Couplers
The magenta image coupler utilized in the invention may be any magenta imaging coupler known in the art. Suitable is a pyrazole of the following structure:

II

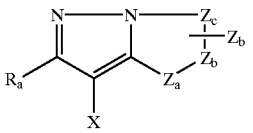

wherein $R_a$ and $R_b$ independently represent H or a substituent; X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Preferred magenta couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S. Pat. Nos. 4,659,652; 5,066,575; and 5,250,400.

In particular, pyrazoloazole magenta couplers of general structures PZ-1 and PZ-2 are suitable:

PZ-1

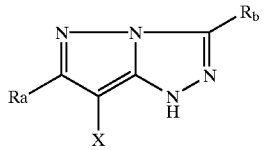

PZ-2

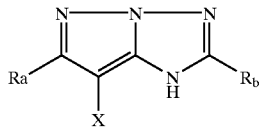

wherein $R_a$, $R_b$, and X are as defined for formula (II).

Particularly preferred are the two-equivalent versions of magenta couplers PZ-1 and PZ-2 wherein X is not hydrogen. This is the case because of the advantageous drop in silver required to reach the desired density in the print element.

Other examples of suitable magenta couplers are those based on pyrazolones as described hereinafter.

Typical magenta couplers that may be used in the inventive photographic element are shown below.

M-1

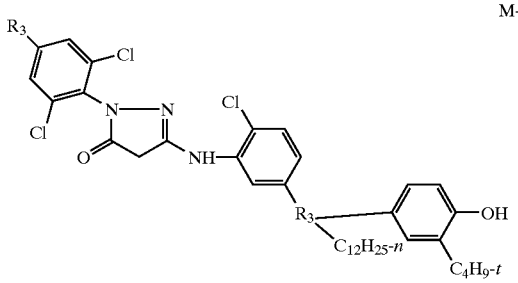

M-2

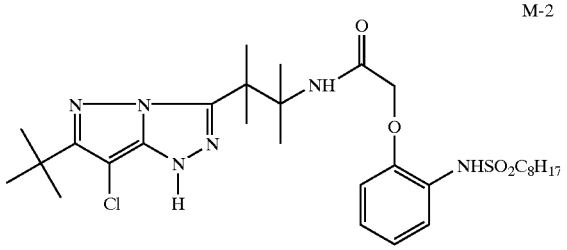

M-3

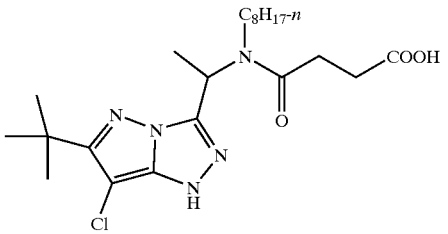

M-4

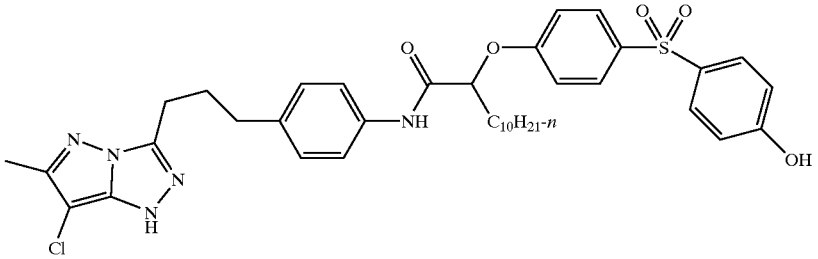

-continued

M-5

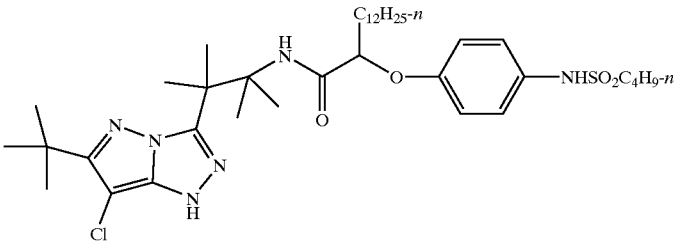

M-6

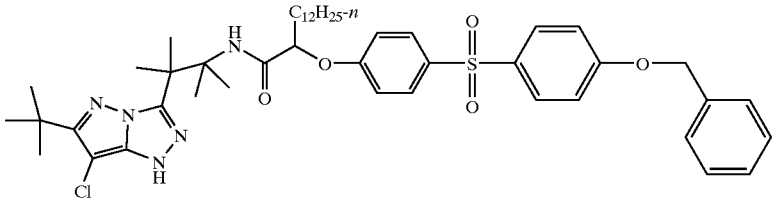

M-7

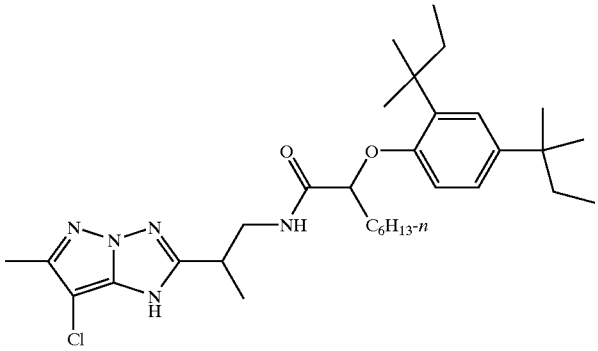

M-8

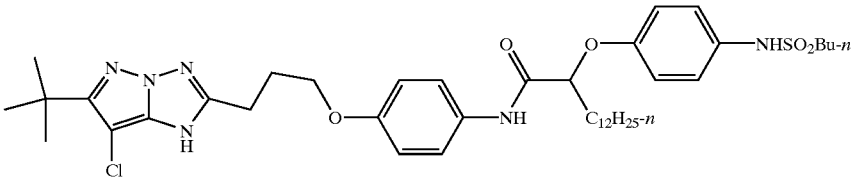

M-9

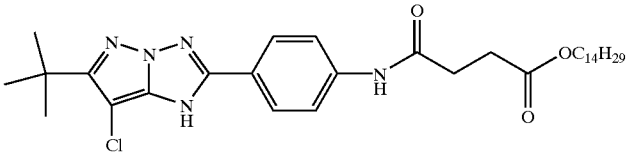

The coupler identified as M-2 is useful because of its narrow absorption band.

Yellow Image Couplers

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

Typical preferred yellow couplers are represented by the following formulas:

YELLOW-1

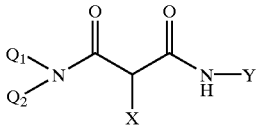

YELLOW-2

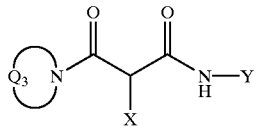

YELLOW-3

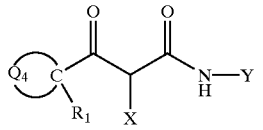

YELLOW-4

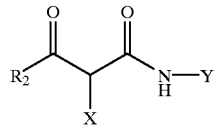

YELLOW-5

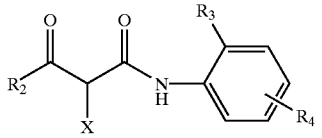

wherein $R_1$, $R_2$, $R_3$, $R_4$, $Q_1$ and $Q_2$ each represents a substituent; X is hydrogen or a coupling-off group; Y represents an aryl group or a heterocyclic group; $Q_3$ represents an organic residue required to form a nitrogen-containing heterocyclic group together with the >N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represents an alkyl group, an aryl group, or a heterocyclic group, and $R_2$ represents an aryl or tertiary alkyl group. Preferred yellow couplers for use in elements of the invention are represented by YELLOW-4, wherein $R_2$ represents a tertiary alkyl group, Y represents an aryl group, and X represents an aryloxy or N-heterocyclic coupling-off group.

The most preferred yellow couplers are represented by YELLOW-5, wherein $R_2$ represents a tertiary alkyl group, $R_3$ represents a halogen or an alkoxy substituent, $R_4$ represents a substituent, and X represents a N-heterocyclic coupling-off group because of their good development and desirable color.

Even more preferred are yellow couplers are represented by YELLOW-5, wherein $R_2$, $R_3$ and $R_4$ are as defined above, and X is represented by the following formula:

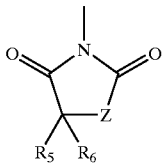

wherein Z is oxygen of nitrogen and $R_5$ and $R_6$ are substituents. Most preferred are yellow couplers wherein Z is oxygen and $R_5$ and $R_6$ are alkyl groups.

Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arylsulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

Examples of the yellow couplers suitable for use in the invention are the acylacetanilide couplers, such as those having formula III:

III

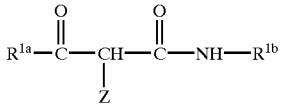

wherein Z represents hydrogen or a coupling-off group bonded to the coupling site in each of the above formulae. In the above formulae, when $R^{1a}$, $R^{1b}$, $R^{1d}$, or $R^{1f}$ contains a ballast or anti-diffusing group, it is selected so that the total number of carbon atoms is at least 8 and preferably at least 10.

$R^{1a}$ represents an aliphatic (including alicyclic) hydrocarbon group, and $R^{1b}$ represents an aryl group.

The aliphatic- or alicyclic hydrocarbon group represented by $R^{1a}$ typically has at most 22 carbon atoms, may be substituted or unsubstituted, and aliphatic hydrocarbon may be straight or branched. Preferred examples of the substituent for these groups represented by $R^{1a}$ are an alkoxy group, an aryloxy group, an amino group, an acylamino group, and a halogen atom. These substituents may be further substituted with at least one of these substituents repeatedly. Useful examples of the groups as $R^{1a}$ include an isopropyl group, an isobutyl group, a tert-butyl group, an isoamyl group, a tert-amyl group, a 1,1-dimethyl-butyl group, a 1,1-dimethylhexyl group, a 1,1-diethylhexyl group, a dodecyl group, a hexadecyl group, an octadecyl group, a cyclohexyl group, a 2-methoxyisopropyl group, a 2-phenoxyisopropyl group, a 2-p-tert-butylphenoxyisopropyl group, an a-aminoisopropyl group, an a-(diethyl-amino)isopropyl group, an a-(succinimido) isopropyl group, an a-(phthal-imido)isopropyl group, an a-(benzenesulfonamido)isopropyl group, and the like.

As an aryl group, (especially a phenyl group), $R^{1b}$ may be substituted. The aryl group (e.g., a phenyl group) may be substituted with substituent groups typically having not more than 32 carbon atoms such as an alkyl group, an alkenyl group, an alkoxy group, an alkoxycarbonyl group, an alkoxycarbonylamino group, an aliphatic- or alicyclic-amido group, an alkylsulfamoyl group, an alkylsulfonamido group, an alkylureido group, an aralkyl group and an alkyl-substituted succinimido group. This phenyl group in the aralkyl group may be further substituted with groups such as an aryloxy group, an aryloxycarbonyl group, an arylcarbamoyl group, an arylamido group, an arylsulfamoyl group, an arylsulfonamido group, and an arylureido group.

The phenyl group represented by $R^{1b}$ may be substituted with an amino group which may be further substituted with a lower alkyl group having from 1 to 6 carbon atoms, a hydroxyl group, —COOM and —$SO_2$M (M=H, an alkali metal atom, $NH_4$), a nitro group, a cyano group, a thiocyano group, or a halogen atom.

In a preferred embodiment, the phenyl group represented by $R^{1b}$ is a phenyl group having in the position ortho to the anilide nitrogen a halogen such as fluorine, chlorine or an alkoxy group such as methoxy, ethoxy, propoxy, butoxy. Alkoxy groups of less than 8 carbon atoms are preferred.

$R^{1b}$ may represent substituents resulting from condensation of a phenyl group with other rings, such as a naphthyl group, a quinolyl group, an isoquinolyl group, a chromanyl group, a coumaranyl group, and a tetrahydronaphthyl group. These substituents may be further substituted repeatedly with at least one of above-described substituents for the phenyl group.

$R^{1d}$ and $R^{1f}$ represent a hydrogen atom, or a substituent group (as defined hereafter in the passage directed to substituents).

Representative examples of yellow couplers useful in the present invention are as follows:

Y-1

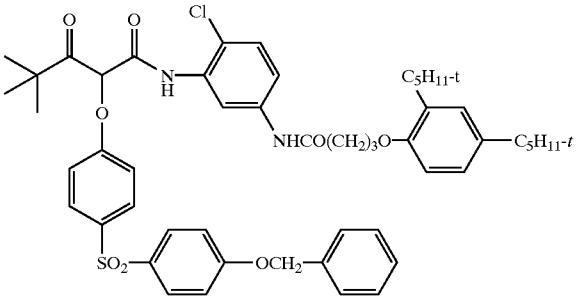

Y-2

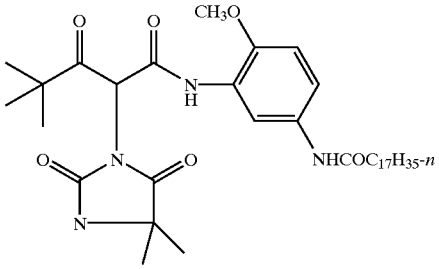

Y-3

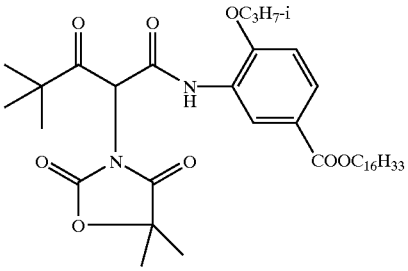

Y-4

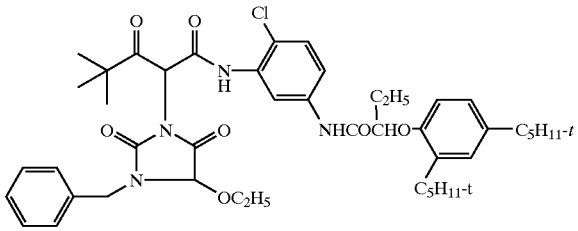

Y-5

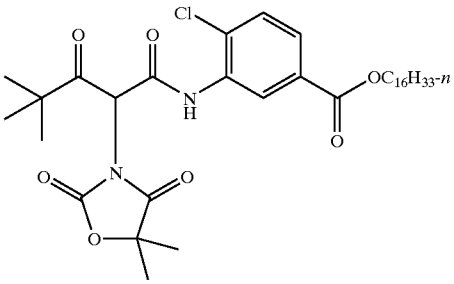

Y-6

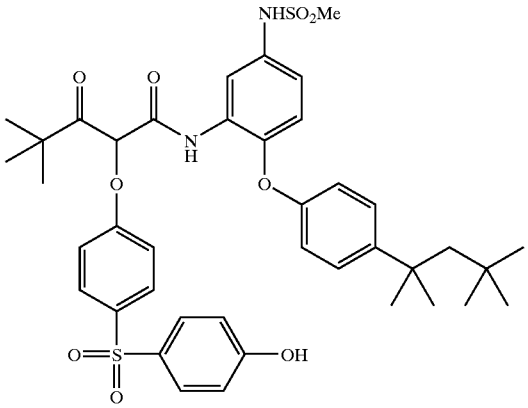

Y-7

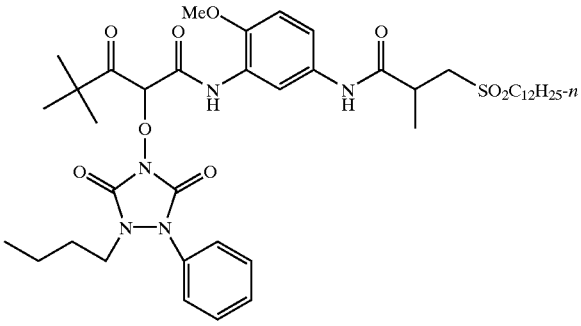

Y-8

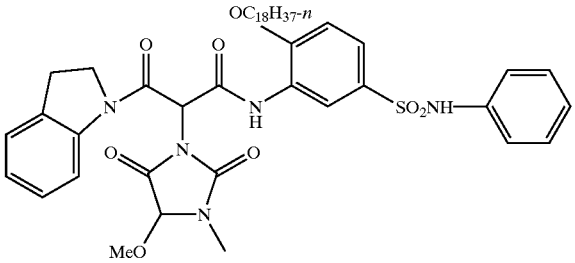

-continued

Y-9

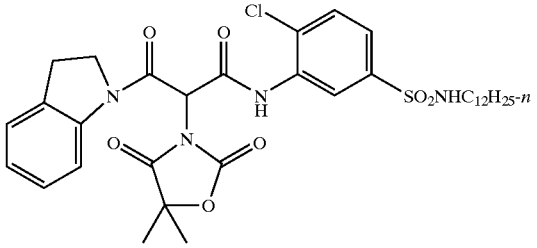

Y-10

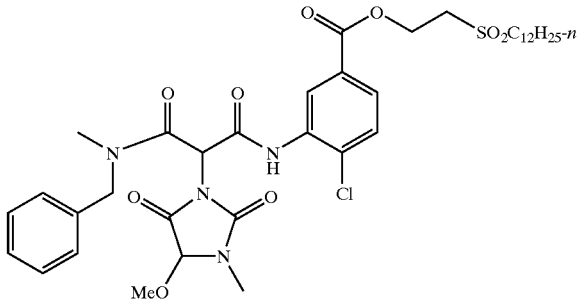

Y-11

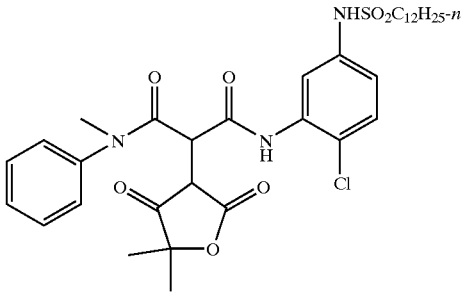

Y-12

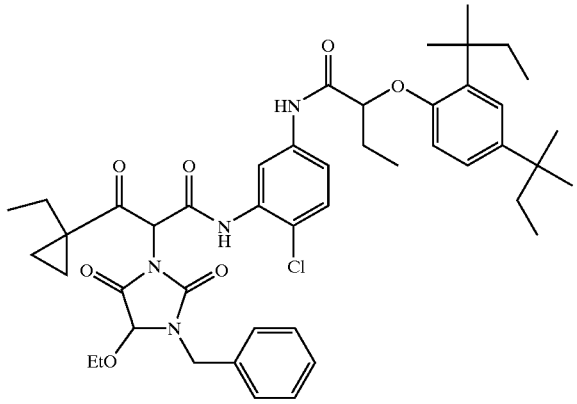

Y-13

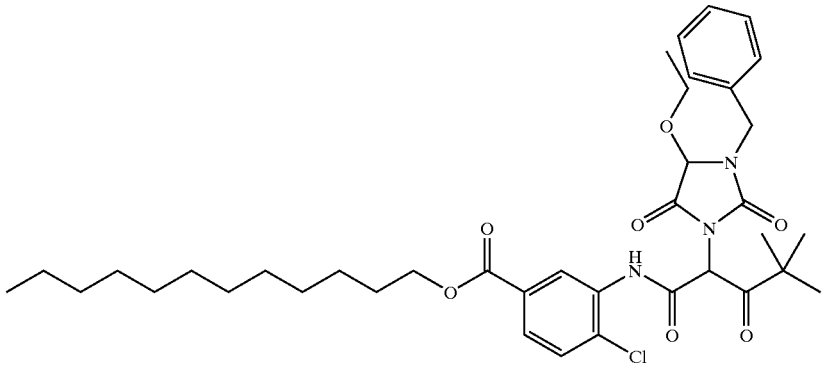

Throughout this specification, unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituents unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy)butyramido, alpha-(3-pentadecylphenoxy)-hexanamido, alpha-(4-hydroxy-3-t-butylphenoxy)-tetradecanamido, 2-oxo-pyrrolidin- 1-yl, 2-oxo-5-tetradecylpyrrolin- 1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, unless provided otherwise, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The color photographic elements of the invention are multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94–6023, published Mar. 15, 1994, available from the Japanese Patent Office. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1994, Item 36544, available as described above, which will be identified hereafter by the term "Research Disclosure". Sections hereafter referred to are Sections of the Research Disclosure.

Except as provided, the silver halide emulsion containing elements employed in this invention can be either negative-working or positive-working as indicated by the type of processing instructions (i.e., color negative, reversal, or direct positive processing) provided with the element. Suitable emulsions and their preparation, as well as methods of chemical and spectral sensitization, are described in Sections I–V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI–VIII. Color materials are described in Sections X–XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure,* Item 37038, February 1995.

Couplers that form magenta dyes upon reaction with oxidized color developing agent are described in such representative patents and publications as: U.S. Pat. Nos. 2,311,082; 2,343,703; 2,369,489; 2,600,788; 2,908,573; 3,062,653; 3,152,896; 3,519,429; 3,758,309; 4,540,654; and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298, 443; 2,407,210; 2,875,057; 3,048,194; 3,265,506; 3,447, 928; 4,022,620; 4,443,536; and "Farbkuppler-eine Literature Ubersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as U.K. Patent No. 861,138 and U.S. Pat. Nos. 3,632,345; 3,928,041; 3,958,993; and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628; 5,151, 343; and 5,234,800.

It may be useful to use a combination of couplers any of which may contain known ballasts or coupling-off groups such as those described in U.S. Pat. Nos. 4,301,235; 4,853, 319; and 4,351,897. The coupler may contain solubilizing groups such as described in U.S. Pat. No. 4,482,629.

The invention materials may be used in association with materials that accelerate or otherwise modify the processing steps, e.g., of bleaching or fixing to improve the quality of the image. Bleach accelerator releasing couplers such as those described in EP 0 193,389; EP 0 301,477; and U.S. Pat. Nos. 4,163,669; 4,865,956; and 4,923,784 may be useful. Also contemplated is use of the compositions in association with nucleating agents, development-accelerators or their precursors (UK Patent Nos. 2,097,140 and 2,131,188); electron transfer agents (U.S. Pat. Nos. 4,859,578 and 4,912, 025); antifogging and anticolor-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, 'blue', cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384, 657; 3,379,529; 3,615,506; 3,617,291; 3,620,746; 3,701, 783; 3,733,201; 4,049,455; 4,095,984; 4,126,459; 4,149, 886; 4,150,228; 4,211,562; 4,248,962; 4,259,437; 4,362, 878; 4,409,323; 4,477,563; 4,782,012; 4,962,018; 4,500, 634; 4,579,816; 4,607,004; 4,618,571; 4,678,739; 4,746, 600; 4,746,601; 4,791,049; 4,857,447; 4,865,959; 4,880, 342; 4,886,736; 4,937,179; 4,946,767; 4,948,716; 4,952, 485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; and 401,613.

Such compounds are also disclosed in "Developer-Inhibitor-Releasing (DIR) Couplers for Color Photography," C. R. Barr, J. R. Thirtle and P. W. Vittum in Photographic Science and Engineering, Vol. 13, p. 174 (1969). Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

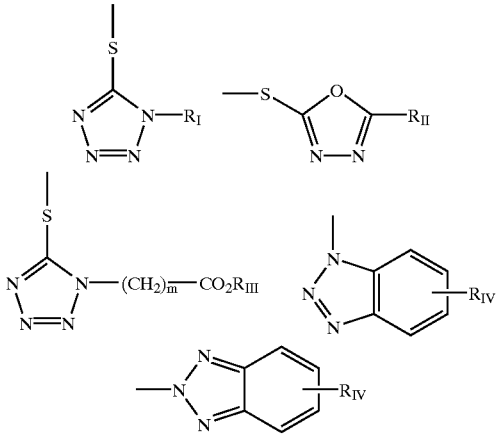

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

It is contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire PO101 7DQ, England. Materials of the invention may be coated on pH adjusted support as described in U.S. Pat. No. 4,917,994; on a support with reduced oxygen permeability (EP 553,339); with epoxy solvents (EP 164,961); with nickel complex stabilizers (U.S. Pat. Nos. 4,346,165; 4,540,653 and 4,906,559, for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83–09,959.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in U.S. Pat. Nos. 5,292,634 and 5,316,904 in conjunction with elements of the invention.

In addition, emulsions can be sensitized with mixtures of two or more sensitizing dyes which form mixed dye aggregates on the surface of the emulsion grain. The use of mixed dye aggregates enables adjustment of the spectral sensitivity of the emulsion to any wavelength between the extremes of the wavelengths of peak sensitivities (λ-max) of the two or more dyes. This practice is especially valuable if the two or more sensitizing dyes absorb in similar portions of the spectrum (i.e., blue, or green or red and not green plus red or blue plus red or green plus blue). Since the function of the spectral sensitizing dye is to modulate the information recorded in the negative which is recorded as an image dye, positioning the peak spectral sensitivity at or near the λ-max of the image dye in the color negative produces the optimum preferred response.

In addition, emulsions of this invention may contain a mixture of spectral sensitizing dyes which are substantially different in their light absorptive properties. For example, Hahm in U.S. Pat. No. 4,902,609 describes a method for broadening the effective exposure latitude of a color negative paper by adding a smaller amount of green spectral sensitizing dye to a silver halide emulsion having predominately a red spectral sensitivity. Thus, when the red sensitized emulsion is exposed to green light, it has little, if any, response. However, when it is exposed to larger amounts of green light, a proportionate amount of cyan image dye will be formed in addition to the magenta image dye, causing it to appear to have additional contrast and hence a broader exposure latitude.

Waki et al in U.S. Pat. No. 5,084,374 describes a silver halide color photographic material in which the red spectrally sensitized layer and the green spectrally sensitized layers are both sensitized to blue light. Like Hahm, the second sensitizer is added in a smaller amount to the primary sensitizer. When these imaging layers are given a large enough exposure of the blue light exposure, they produce yellow image dye to complement the primary exposure. This process of adding a second spectral sensitizing dye of different primary absorption is called false-sensitization.

Any silver halide combination can be used, such as silver chloride, silver chlorobromide, silver chlorobromoiodide, silver bromide, silver bromoiodide, or silver chloroiodide. Due to the need for rapid processing of the color paper, silver chloride emulsions are preferred. In some instances, silver chloride emulsions containing small amounts of bromide, or iodide, or bromide and iodide are preferred, generally less than 2.0 mole percent of bromide less than 1.0 mole percent of iodide. Bromide or iodide addition when forming the emulsion may come from a soluble halide source such as potassium iodide or sodium bromide or an organic bromide or iodide or an inorganic insoluble halide such as silver bromide or silver iodide.

The shape of the silver halide emulsion grain can be cubic, pseudo-cubic, octahedral, tetradecahedral or tabular. It is preferred that the 3-dimensional grains be monodisperse and that the grain size coefficient of variation of the 3-dimensional grains is less than 35% or, most preferably less than 25%. The emulsions may be precipitated in any suitable environment such as a ripening environment, or a reducing environment. Specific references relating to the preparation of emulsions of differing halide ratios and morphologies are Evans U.S. Pat. No. 3,618,622; Atwell U.S. Pat. No. 4,269,927; Wey U.S. Pat. No. 4,414,306; Maskasky U.S. Pat. No. 4,400,463; Maskasky U.S. Pat. No. 4,713,323; Tufano et al U.S. Pat. No. 4,804,621; Takada et al U.S. Pat. No. 4,738,398; Nishikawa et al U.S. Pat. No. 4,952,491; Ishiguro et al U.S. Pat. No. 4,493,508; Hasebe et al U.S. Pat. No. 4,820,624; Maskasky U.S. Pat. No. 5,264,337; and Brust et al EP 534,395.

The combination of similarly spectrally sensitized emulsions can be in one or more layers, but the combination of emulsions having the same spectral sensitivity should be such that the resultant D vs. log-E curve and its corresponding instantaneous contrast curve should be such that the instantaneous contrast of the combination of similarly spectrally sensitized emulsions generally increases as a function of exposure.

Emulsion precipitation is conducted in the presence of silver ions, halide ions and in an aqueous dispersing medium including, at least during grain growth, a peptizer. Grain structure and properties can be selected by control of precipitation temperatures, pH and the relative proportions of silver and halide ions in the dispersing medium. To avoid fog, precipitation is customarily conducted on the halide side of the equivalence point (the point at which silver and halide ion activities are equal). Manipulations of these basic parameters are illustrated by the citations including emulsion precipitation descriptions and are further illustrated by Matsuzaka et al U.S. Pat. No. 4,497,895, Yagi et al U.S. Pat. No. 4,728,603, Sugimoto U.S. Pat. No. 4,755,456, Kishita et al U.S. Pat. No. 4,847,190, Joly et al U.S. Pat. No. 5,017,468, Wu U.S. Pat. No. 5,166,045, Shibayama et al EPO 0 328 042, and Kawai EPO 0 531 799.

Reducing agents present in the dispersing medium during precipitation can be employed to increase the sensitivity of the grains, as illustrated by Takada et al U.S. Pat. No. 5,061,614, Takada U.S. Pat. No. 5,079,138 and EPO 0 434 012, Inoue U.S. Pat. No. 5,185,241, Yamashita et al EPO 0 369 491, Ohashi et al EPO 0 371 338, Katsumi EPO 435 270 and 0 435 355 and Shibayama EPO 0 438 791. Chemically sensitized core grains can serve as hosts for the precipitation of shells, as illustrated by Porter et al U.S. Pat. Nos. 3,206,313 and 3,327,322, Evans U.S. Pat. No. 3,761,276, Atwell et al U.S. Pat. No. 4,035,185 and Evans et al U.S. Pat. No. 4,504,570.

Dopants (any grain occlusions other than silver and halide ions) can be employed to modify grain structure and properties. Periods 3–7 ions, including Group VIII metal ions (Fe, Co, Ni and platinum metals (pm) Ru, Rh, Pd, Re, Os, Ir and Pt), Mg, Al, Ca, Sc, Ti, V, Cr, Mn, Cu Zn, Ga, As, Se, Sr, Y, Mo, Zr, Nb, Cd, In, Sn, Sb, Ba, La, W, Au, Hg, Tl, Pb, Bi, Ce and U can be introduced during precipitation. The dopants can be employed (a) to increase the sensitivity of either (a1) direct positive or (a2) negative working emulsions, (b) to reduce (b1) high or (b2) low intensity reciprocity failure, (c) to (c1) increase, (c2) decrease or (c3) reduce the variation of contrast, (d) to reduce pressure sensitivity, (e) to decrease dye desensitization, (f) to increase stability, (g) to reduce minimum density, (h) to increase maximum density, (i) to improve room light handling and (j) to enhance latent image formation in response to shorter wavelength (e.g., X-ray or gamma radiation) exposures. For some uses any polyvalent metal ion (pvmi) is effective. The selection of the host grain and the dopant, including its concentration and, for some uses, its location within the host grain and/or its valence can be varied to achieve aim photographic properties, as illustrated by B. H. Carroll, "Iridium Sensitization: A Literature Review", Photographic Science and Engineering, Vol. 24, No. 6 November/December 1980, pp. 265–267 (pm, Ir, a, b and d); Hochstetter U.S. Pat. No. 1,951,933 (Cu); De Witt U.S. Pat. No. 2,628,167 (Tl, a, c); Mueller et al U.S. Pat. No. 2,950,972 (Cd, j); Spence et al U.S. Pat. No. 3,687,676 and Gilman et al U.S. Pat. No. 3,761,267 (Pb, Sb, Bi, As, Au, Os, Ir, a); Ohkubu et al U.S. Pat. No. 3,890,154 (VIII, a); Iwaosa et al U.S. Pat. No. 3,901,711 (Cd, Zn, Co, Ni, Tl, U, Th, Ir, Sr, Pb, b1); Habu et al U.S. Pat. No. 4,173,483 (VIII, b1); Atwell U.S. Pat. No. 4,269,927 (Cd, Pb, Cu, Zn, a2); Weyde U.S. Pat. No. 4,413,055 (Cu, Co, Ce, a2); Akimura et al U.S. Pat. No. 4,452,882 (Rh, i); Menjo et al U.S. Pat. No. 4,477,561 (pm, f); Habu et al U.S. Pat. No. 4,581,327 (Rh, cl, f); Kobuta et al U.S. Pat. No. 4,643,965 (VIII, Cd, Pb, f, c2); Yamashita et al U.S. Pat. No. 4,806,462 (pvmi, a2, g); Grzeskowiak et al U.S. Pat. No. 4,4,828,962 (Ru+Ir, b1); Janusonis U.S. Pat. No. 4,835,093 (Re, al); Leubner et al U.S. Pat. No. 4,902,611 (Ir+4); Inoue et al U.S. Pat. No. 4,981,780 (Mn, Cu, Zn, Cd, Pb, Bi, In, Ti, Zr, La, Cr, Re, VIII, ci, g, h); Kim U.S. Pat. No. 4,997,751 (Ir, b2); Kuno U.S. Pat. No. 5,057,402 (Fe, b, f); Maekawa et al U.S. Pat. No. 5,134,060 (Ir, b, c3); Kawai et al U.S. Pat. No. 5,164,292 (Ir+Se, b); Asamni U.S. Pat. Nos. 5,166,044 and 5,204,234 (Fe+Ir, a2 b, c1, c3); Wu U.S. Pat. No. 5,166,045 (Se, a2); Yoshida et al U.S. Pat. No. 5,229,263 (Ir+Fe/Re/Ru/Os, a2, b1); Marchetti et al U.S. Pat. Nos. 5,264,336 and 5,268,264 (Fe, g); Komarita et al EPO 0 244 184 (Ir, Cd, Pb, Cu, Zn, Rh, Pd, Pt, Ti, Fe, d); Miyoshi et al EPO 0 488 737 and 0 488 601 (Ir+VIII/Sc/Ti/V/Cr/Mn/Y/Zr/Nb/Mo/La/Ta/W/Re, a2, b, g); Ihama et al EPO 0 368 304 (Pd, a2, g); Tashiro EPO 0 405 938 (Ir, a2, b); Murakami et al EPO 0 509 674 (VIII, Cr, Zn, Mo, Cd, W, Re, Au, a2, b, g) and Budz WO 93/02390 (Au, g); Ohkubo et al U.S. Pat. No. 3,672,901 (Fe, a2, 01); Yamnasue et al U.S. Pat. No. 3,901,713 (Ir+Rh, f); and Miyoshi et al EPO 0 488 737.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, nitrosyl, thionitrosyl, oxo, carbonyl and ethylenediamnine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781, and 5,037,732; Marchetti et al U.S. Pat. No. 4,937,180; Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320, and Olm et al U.S. Pat. No. 5,360,712.

Oligomeric coordination complexes can also be employed to modify grain properties, as illustrated by Evans et al U.S. Pat. No. 5,024,931.

Dopants can be added in conjunction with addenda, antifoggants, dye, and stabilizers either during precipitation of the grains or post precipitation, possibly with halide ion addition. These methods may result in dopant deposits near or in a slightly subsurface fashion, possibly with modified emulsion effects, as illustrated by Ihama et al U.S. Pat. No. 4,693,965 (Ir, a2); Shiba et al U.S. Pat. No. 3,790,390 (Group VIII, a2, b1); Habu et al U.S. Pat. No. 4,147,542 (Group VIII, a2, b1); Hasebe et al EPO 0 273 430 (Ir, Rh, Pt); Ohshima et al EPO 0 312 999 (Ir, f); and Ogawa U.S. Statutory Invention Registration H760 (Ir, Au, Hg, Tl, Cu, Pb, Pt, Pd, Rh, b, f).

Desensitizing or contrast increasing ions or complexes are typically dopants which function to trap photogenerated holes or electrons by introducing additional energy levels deep within the bandgap of the host material. Examples include, but are not limited to, simple salts and complexes of Groups 8–10 transition metals (e.g., rhodium, iridium, cobalt, ruthenium, and osmium), and transition metal complexes containing nitrosyl or thionitrosyl ligands as described by McDugle et al U.S. Pat. No. 4,933,272. Specific examples include $K_3RhCl_6$, $(NH_4)_2Rh(Cl_5)H_2O$, $K_2IrCl_6$, $K_3IrCl_6$, $K_2IrBr_6$, $K_2IrBr_6$, $K_2RuCl_6$, $K_2Ru(NO)Br_5$, $K_2Ru(NS)Br_5$, $K_2OsCl_6$, $Cs_2Os(NO)Cl_5$, and $K_2Os(NS)Cl_5$. Amine, oxalate, and organic ligand complexes of these or other metals as disclosed in Olm et al U.S. Pat. No. 5,360,712 are also specifically contemplated.

Shallow electron trapping ions or complexes are dopants which introduce additional net positive charge on a lattice site of the host grain, and which also fail to introduce an additional empty or partially occupied energy level deep within the bandgap of the host grain. For the case of a six coordinate transition metal dopant complex, substitution into the host grain involves omission from the crystal structure of a silver ion and six adjacent halide ions (collectively referred to as the seven vacancy ions). The seven vacancy ions exhibit a net charge of −5. A six coordinate dopant complex with a net charge more positive than −5 will introduce a net positive charge onto the local lattice site and can function as a shallow electron trap. The presence of additional positive charge acts as a scattering center through the Coulomb force, thereby altering the kinetics of latent image formation.

Based on electronic structure, common shallow electron trapping ions or complexes can be classified as metal ions or complexes which have (i) a filled valence shell or (ii) a low spin, half-filled d shell with no low-lying empty or partially filled orbitals based on the ligand or the metal due to a large crystal field energy provided by the ligands. Classic examples of class (i) type dopants are divalent metal complex of Group II, e.g., Mg(2+), Pb(2+), Cd(2+), Zn(2+), Hg(2+), and Tl(3+). Some type (ii) dopants include Group VIII complex with strong crystal field ligands such as cyanide and thiocyanate. Examples include, but are not limited to, iron complexes illustrated by Ohkubo U.S. Pat. No. 3,672,901; and rhenium, ruthenium, and osmium complexes disclosed by Keevert U.S. Pat. No. 4,945,035; and iridium and platinum complexes disclosed by Ohshima et al U.S. Pat. No. 5,252,456. Preferred complexes are ammonium and alkali metal salts of low valent cyanide complexes such as $K_4Fe(CN)_6$, $K_4Ru(CN)_6$, $K_4Os(CN)_6$, $K_2Pt(CN)_4$, and $K_3Ir(CN)_6$. Higher oxidation state complexes of this type, such as $K_3Fe(CN)_6$ and $K_3Ru(CN)_6$, can also possess shallow electron trapping characteristics, particularly when any partially filled electronic states which might reside within the bandgap of the host grain exhibit limited interaction with photocharge carriers.

Emulsion addenda that absorb to grain surfaces, such as antifoggants, stabilizers and dyes can also be added to the emulsions during precipitation. Precipitation in the presence of spectral sensitizing dyes is illustrated by Locker U.S. Pat. No. 4,183,756, Locker et al U.S. Pat. No. 4,225,666, Ihama et al U.S. Pat. Nos. 4,683,193 and 4,828,972, Takagi et al U.S. Pat. No. 4,912,017, Ishiguro et al U.S. Pat. No. 4,983,508, Nakayama et al U.S. Pat. No. 4,996,140, Steiger U.S. Pat. No. 5,077,190, Brugger et al U.S. Pat. No. 5,141,845, Metoki et al U.S. Pat. No. 5,153,116, Asami et al EPO 0 287 100 and Tadaaki et al EPO 0 301 508. Non-dye addenda are illustrated by Klotzer et al U.S. Pat. No. 4,705,747, Ogi et al U.S. Pat. No. 4,868,102, Ohya et al U.S. Pat. No. 5,015,563, Bahnmuller et al U.S. Pat. No. 5,045,444, Maeka et al U.S. Pat. No. 5,070,008, and Vandenabeele et al EPO 0 392 092.

Chemical sensitization of the materials in this invention is accomplished by any of a variety of known chemical sensitizers. The emulsions described herein may or may not have other addenda such as sensitizing dyes, supersensitizers, emulsion ripeners, gelatin or halide conversion restrainers present before, during or after the addition of chemical sensitization.

The use of sulfur, sulfur plus gold or gold only sensitizations are very effective sensitizers. Typical gold sensitizers are chloroaurates, aurous dithiosulfate, aqueous colloidal gold sulfide or gold (aurous bis(1,4,5-trimethyl-1,2,4-triazolium-3-thiolate) tetrafluoroborate. Sulfur sensitizers may include thiosulfate, thiocyanate or N,N'-carbobothioyl-bis(N-methylglycine).

The addition of one or more antifoggants as stain reducing agents is also common in silver halide systems. Tetrazaindenes, such as 4-hydroxy-6-methyl-(1,3,3a,7)-tetrazaindene, are commonly used as stabilizers. Also useful are mercaptotetrazoles such as 1-phenyl-5-mercaptotetrazole or acetamido-1-phenyl-5-mercaptotetrazole. Arylthiosulfinates, such as tolylthiosulfonate or arylsufinates such as tolylthiosulfinate or esters thereof are also useful.

Useful in this invention are tabular grain silver halide emulsions. Specifically contemplated tabular grain emulsions are those in which greater than 50 percent of the total projected area of the emulsion grains are accounted for by tabular grains having a thickness of less than 0.3 $\mu$m (0.5 $\mu$m for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 $\mu$m, although in practice emulsion ECD's seldom exceed about 4 $\mu$m. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin ($t<0.2$ $\mu$m) tabular grains. To achieve the lowest levels of granularity it is preferred that aim tabular grain projected areas be satisfied with ultrathin ($t<0.06$ $\mu$m) tabular grains. Tabular grain thicknesses typically range down to about 0.02 $\mu$m. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 $\mu$m. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity, it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

To prevent halation during exposure, an antihalation layer needs to be provided between the bottom most light sensitive layer on either side of the transparent support. The antihalation layer acts as a photon trap, absorbing photons of light, which was not part of the latent image formation process after exposure. This layer prevents light from being scattered throughout the photographic element, where it could potentially expose silver halide grains not inline with the exposing beam of incident exposure light. Eliminating the light that is not part of the latent image forming process eliminates halation and increases image sharpness. This is especially important when a scanning exposing device is employed on integral lenticular materials, since the lines of image information are very narrow, typically 5$\mu$ to 10$\mu$ in diameter. If the consecutive adjacent lines of image information differ significantly in intensity and which subsequently result in significantly different amount of image density, if the element is un-sharp, the lines will broaden unnecessarily and merge in such a way that the distinct separate images will appear undistinguished from each other. Thus an image scene which is predominantly "dark" which is arranged adjacent to an image scene which is predominately "light" will visually blur together in the eyes of the observer and reduce the apparent quality of the image.

Antihalation layers are common in most color negative films such as Kodak Advantix™ film and also are found in some color print films such as Kodak Vision Color Print Film™ or Kodak Duraclear RA Display Material™. Antihalation materials are incorporated to absorb light not absorbed as part of the imaging process. This material is typically 'gray' in color and absorbs light of all color. A variety of materials have been suggested to fill this requirement. Finely dispersed carbon black is used in some products and is known in the trade as 'rem-jet'. It must be removed prior to the chemical development step via a pre-bath and as such must be coated on the side of the support opposite the imaging layers as it cannot be solubilized during the processing cycles. Finely divided elemental silver is also widely used in many color negative films. This material is known as 'gray gel' and is easily removed in the chemical development process-during the bleaching and fixing steps. In some products, mixtures of water soluble cyan, magenta, and yellow dyes are coated in a separate layer (usually on the side of the support opposite the emulsion layers). If these water soluble dyes are coated on the same side of the support as the emulsions, they diffuse into the emulsion layers after the coating operation and retard the photographic speed of the photographic element. Since these dye are aqueous soluble, they are conveniently removed during processing via diffusion or reaction with alkali or sulfite in the color developer.

To overcome this tendency, solid particle dispersions of these dyes have been developed. The dyes in these formulations are insoluble under all but alkaline conditions so that they remain in the layer in which they are coated, but can be removed by hydrolysis or ionization during the chemical development step of the photographic process.

With negative-working silver halide, the processing step described above provides a negative image. The described elements can be processed in the known Kodak RA-4 color process as described the British Journal of Photography Annual of 1988, pp. 198–199. To provide a positive (or reversal) image, the color development step can be preceded by development with a non-chromogenic developing agent to develop exposed silver halide, but not form dye, and followed by uniformly fogging the element to render unexposed silver halide developable. Such reversal emulsions are typically sold with instructions to process using a color reversal process such as E-6. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamido-ethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

A direct-view photographic element is defined as one which yields a color image that is designed to be viewed directly (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by optically printing an image from a color negative onto the direct-viewing element and processing though an appropriate negative-working photographic process to give a positive color image. Color slides may be produced in a similar manner but are more typically produced by exposing the film directly in a camera and processing through a reversal color process or a direct positive process to give a positive color image. The image may also be produced by alternative processes such as digital printing.

Each of these types of photographic elements has its own particular requirements for dye hue, but in general, they all require cyan dyes that whose absorption bands are less deeply absorbing (that is, shifted away from the red end of the spectrum) than color negative films. This is because dyes in direct viewing elements are selected to have the best appearance when viewed by human eyes, whereas the dyes in color negative materials designed for optical printing are designed to best match the spectral sensitivities of the print materials.

Photographic Examples 1 to 7

Dispersions of example couplers were emulsified by methods well known to the art, and were coated on the face side of a doubly extruded polyethylene coated color paper support or transparent polymeric support as appropriate for the example, using conventional coating techniques. The gelatin layers were hardened with bis (vinylsulfonyl methyl) ether at 2.4% of the total gelatin. The preparation and composition of the individual layers and their components is given as follows:

Dispersion Formulations

Dispersions such as CD were formulated as follows:

The oil phase of the dispersion formula is composed of a mixture of:

| | |
|---|---|
| Coupler C-1 | 100.0 g |
| Di-n-butyl phthalate | 100.0 g |
| Tinuvin 328 ™ | 64.3 g |
| 2-(2-butoxyethoxy)ethylacetate | 8.2 g |

The aqueous phase of the dispersion is composed of a mixture of:

| | |
|---|---|
| Gelatin | 120.0 g |
| Alkanol XC ™ surfactant | 12.0 g |
| Water | 1574.0 g |

Dispersions such as MD were formulated as follows:

The oil phase of the dispersion formula is composed of a mixture of:

| | |
|---|---|
| Coupler M-2 | 100.0 g |
| Oleyl alcohol | 105.0 g |
| Di-n-undecyl phthalate | 54.0 g |
| 2-(2-butoxyethoxy)ethylacetate | 10.0 g |
| ST-21 | 19.3 g |
| ST-22 | 131.8 g |

Dispersions such as YD were formulated as follows:

The oil phase of the dispersion formula is composed of a mixture of:

| | |
|---|---|
| Coupler Y-5 | 100.0 g |
| Tri-butyl-citrate | 52.6 g |
| 2-(2-butoxyethoxy)ethylacetate | 4.0 g |
| ST-23 | 29.2 g |

Dispersions such as KD-1 were formulated as follows:

The oil phase of the dispersion formula is composed of a mixture of:

| | |
|---|---|
| Coupler C-1 | 50.0 g |
| Coupler M-1 | 37.1 g |
| Coupler Y-13 | 65.6 g |
| Di-n-butyl phthalate | 62.6 g |
| 2-(2-butoxyethoxy)ethylacetate | 78.5 g |

Dispersions such as KD-2 were formulated as follows:

The oil phase of the dispersion formula is composed of a mixture of:

| | |
|---|---|
| Coupler K-73 | 100.0 g |
| N,N-di-butyl lauramide | 200.0 g |

Dispersing Procedure:

1) The materials used in the oil phase are combined and heated to 125° C. with stirring until dissolution occurs.
2) The hot oil phase is quickly added to the aqueous phase which has been pre-heated to 70° C .
3) The mixture is then passed through a colloid mix, collected, then chilled until the dispersion is set.

Emulsion Formulations

Silver chloride emulsions were chemically and spectrally sensitized as is described below.

Blue Sensitive Emulsion (BEM-1, prepared as described in U.S. Pat. No. 5,252,45 1, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ (136 μg/Ag-M) and $K_2IrCl_5$(5-methylthiazole) (72 μg/Ag-M), dopants were added during the silver halide grain formation for most of the precipitation. At 90% of the grain volume, precipitation was halted and a quantity of potassium iodide was added, equivalent to 0.2 M% of the total amount of silver. After addition, the precipitation was completed with the addition of additional silver nitrate and sodium chloride and subsequently followed by a shelling without dopant. The resultant emulsion contained cubic shaped grains of 0.60 μm in edge length. This emulsion was optimally sensitized by the addition of a colloidal suspension of aurous sulfide (18.4 mg/Ag-M) and heat ramped up to 60° C. during which time blue sensitizing dye BSD-4, (388 mg/Ag-M), 1-(3-acetamidophenyl)-5-mercaptotetrazole (93 mg/Ag-M) and potassium bromide (0.5 M%) were added. In addition, iridium dopant $K_2IrCl_6$ (7.4 μg/Ag-M) was added during the sensitization process.

Blue Sensitive Emulsion (BEM-2, prepared as described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ (136 μg/Ag-M) and $K_2IrCl_5$(5-methylthiazole) (72 μg/Ag-M), dopants were added during the silver halide grain formation for most of the precipitation. At 90% of the grain volume, precipitation was halted and a quantity of potassium iodide was added, equivalent to 0.2 M% of the total amount of silver. After addition, the precipitation was completed with the addition of additional silver nitrate and sodium chloride and subsequently followed by a shelling without dopant. The resultant emulsion contained cubic shaped grains of 0.60 μm in edge length. This emulsion was optimally sensitized by the addition of a colloidal suspension of aurous sulfide (18.4 mg/Ag-M) and heat ramped up to 60° C. during which time blue sensitizing dye BSD-2, (414 mg/Ag-M), 1-(3-acetamidophenyl)-5-mercaptotetrazole (93 mg/Ag-M) and potassium bromide (0.5 M%) were added. In addition, iridium dopant $K_2IrCl_6$ (7.4 μg/Ag-M) was added during the sensitization process.

Green Sensitive Emulsion (GEM-1): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ (1.36 μg/Ag-M) dopant and $K_2IrCl_5$(5-methylthiazole ) (0.54 mg/Ag-M) dopant was added during the silver halide grain formation for most of the precipitation, followed by a shelling without dopant. The resultant emulsion contained cubic shaped grains of 0.30 μm in edge length. This emulsion was optimally sensitized by addition of a colloidal suspension of aurous sulfide (12.3 mg/Ag-M), heat digestion, followed by the addition of silver bromide (0.8 M%), green sensitizing dye, GSD-1 (427 mg/Ag-M), and 1-(3-acetamidophenyl)-5-mercaptotetrazole (96 mg/Ag-M).

Red Sensitive Emulsion (REM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length. In addition, ruthenium hexacyanide dopant (at 16.5 mg/Ag-M) and $K_2IrCl_5$(5-methylthiazole) dopant (at 0.99 mg/Ag-M) was added during the precipitation process. This emulsion was optimally sensitized by the addition of a colloidal suspension of aurous sulfide (60 mg/Ag-M) followed by a heat ramp to 65° C. for 45 minutes, and further additions of 1-(3-acetamidophenyl)-5-mercaptotetrazole (295 mg/Ag-M), iridium dopant, $K_2IrCl_6$ (149 μg/Ag-M), potassium bromide, (0.5 Ag-M%), and red sensitizing dye RSD-1 (7.1 mg/Ag-M).

Red Sensitive Emulsion (Red EM-2): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length. In addition, ruthenium hexacyanide dopant (at 16.5 mg/Ag-M) and $K_2IrCl_5$(5-methylthiazole) dopant (0.99 mg/Ag-M) was added during the precipitation process. This emulsion was optimally sensitized by the addition of a colloidal suspension of aurous sulfide (60 mg/Ag-M) followed by a heat ramp to 65° C. for 45 minutes, and further additions of 1-(3-acetamidophenyl)-5-mercaptotetrazole (295 mg/Ag-M), iridium dopant $K_2IrCl_6$ (149 μg/Ag-M), potassium bromide (0.5 Ag-M%), and sensitizing dye GSD-2 (8.9 mg/Ag-M).

Infrared Sensitive Emulsion (FSEM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length. In addition, ruthenium hexacyanide dopant (at 16.5 mg/Ag-M) and $K_2IrCl_5$(5-methylthiazole) dopant (at 0.99 mg/Ag-M) was added during the precipitation process. This emulsion was optimally sensitized by the addition of a colloidal suspension of aurous sulfide (60. mg/Ag-M) followed by a heat ramp to 65° C. for 45 minutes, followed by further additions of antifoggant, 1-(3-acetamidophenyl)-5-mercaptotetrazole (295. mg/Ag-M), iridium dopant ($K_2IrCl_6$ at 149. μg/Ag-M), potassium bromide (0.5 Ag-M%), DYE-5 (300 mg/Ag-M), infrared sensitizing dye IRSD-1 (33.0 mg/Ag-M) and finally, after the emulsion was cooled to 40° C., DYE-4 (10.76 mg/$M^2$).

Infrared Sensitive Emulsion (FSEM-2): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length. In addition, ruthenium hexacyanide dopant (at 16.5 mg/Ag-M) and $K_2IrCl_5$(5-methylthiazole) dopant (at 0.99 mg/Ag-M) was added during the precipitation process. This emulsion was optimally sensitized by the addition of a colloidal suspension of aurous sulfide (60. mg/Ag-M) followed by a heat ramp to 65° C. for 45 minutes, followed by further additions of antifoggant, 1-(3-acetamidophenyl)-5-mercaptotetrazole (295. mg/Ag-M), iridium dopant $K_2IrCl_6$ (149. μg/Ag-M), potassium bromide (0.5 Ag-M%), DYE-5 (300 mg/Ag-M), infrared sensitizing dye IRSD-2 (33.0 mg/Ag-M) and finally, after the emulsion was cooled to 40° C., DYE-4 (10.76 mg/$M^2$).

Infrared Sensitive Emulsion (FSEM-3): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length. In addition, ruthenium hexacyanide dopant (16.5 mg/Ag-M) and $K_2IrCl_5$ (5-methylthiazole) dopant (0.99 mg/Ag-M) was added during the precipitation process. This emulsion was optimally sensitized by the addition of a colloidal suspension of aurous sulfide (60. mg/Ag-M) followed by a heat ramp to 65° C. for 45 minutes, followed by further additions of antifoggant, 1-(3-acetamidophenyl)-5-mercaptotetrazole (295. mg/Ag-M), iridium dopant $K_2IrCl_6$ (149. μg/Ag-M), potassium bromide (0.5 Ag-M%), DYE-5 (300 mg/Ag-M), infrared sensitizing dye IRSD-3 (33.0 mg/Ag-M) and finally, after the emulsion was cooled to 40° C., DYE-4 (10.76 mg/$M^2$).

Infrared Sensitive Emulsion (FSEM-4): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 μm in edge length. In addition, ruthenium hexacyanide dopant (at 16.5 mg/Ag-M) and $K_2IrCl_5$(5-methylthiazole) dopant (0.99 mg/Ag-M) was added during the precipitation process. This emulsion was optimally sensitized by the addition of a colloidal suspension of aurous sulfide (60. mg/Ag-M) followed by a heat ramp to 65° C. for 45 minutes, followed by further additions of antifoggant, 1-(3-acetamidophenyl)-5-mercaptotetrazole (295. mg/Ag-M), iridium dopant $K_2IrCl_6$ (149. μg/Ag-M), potassium bromide (0.5 Ag-M%), DYE-5 (300 mg/Ag-M), infrared sensitizing dye IRSD-4 (33.0 mg/Ag-M) and finally, after the emulsion was cooled to 40° C., DYE-4 (10.76 mg/$M^2$).

After the coatings were prepared, they were exposed via a digital printer whose output devices were co-optimized to align with the spectral sensitivities of the elements described below. After exposing, the elements were processed in the standard Kodak Ektacolor™ RA4 Color Paper development process which is described below:

TABLE 1

Kodak Ektacolor ™ RA-4 Color Developer

| Chemical | Grams/Liter |
|---|---|
| Triethanol amine | 12.41 |
| Phorwite REU ™ | 2.30 |
| Lithium polystyrene sulfonate (30%) | 0.30 |
| N,N-diethylhydroxylamine (85%) | 5.40 |
| Lithium sulfate | 2.70 |
| Kodak color developer CD-3 | 5.00 |
| DEQUEST 2010 ™ (60%) | 1.16 |
| Potassium carbonate | 21.16 |
| Potassium bicarbonate | 2.79 |
| Potassium chloride | 1.60 |
| Potassium bromide | 0.007 |
| Water | to make 1 liter |

pH @ 26.7° C. is 10.04 +/− 0.05 pH @26.7° C. is 10.04+/−0.05

TABLE 2

Kodak Ektacolor ™ RA-4 Bleach-Fix

| Chemical | Grams/Liter |
|---|---|
| Ammonium thiosulfate (56.5%) | 127.40 |
| Sodium metabisulfite | 10.00 |
| Glacial acetic acid | 10.20 |
| Ammonium ferric EDTA (44%) | 110.40 |
| Water | to make 1 liter |

pH @ 26.7° C. is 5.5 +/− 0.10 pH @26.7° C. is 5.5+/−0.10

TABLE 3

Kodak Ektacolor ™ RA-4 Color Paper Process

| Process Step | Time (seconds) |
|---|---|
| Color Development | 45 or 81 |
| Bleach-fix | 45 or 81 |
| Wash | 90 or 162 |
| Dry | |

Processing the exposed paper samples is performed with the developer and bleach-fix temperatures adjusted to 35° C. Washing is performed with tap water at 32.2° C.

The following table gives the spectral sensitivities obtained with the combinations of spectral sensitizing dyes and emulsions provided above.

TABLE 4

Spectral Sensitivities of the Photographic Element

| Color Record | Emulsion | Sensitizing Dye | Peak Spectral Sensitivity |
|---|---|---|---|
| Blue | BEM-2 | BSD-4 | 473 nm |
| Green | GEM-1 | GSD-1 | 550 nm |
| Red | REM-1 | RSD-1 | 695 nm |
| 4th Sensitive | BEM-1 | BSD-2 | 425 nm |
| 5th Sensitive | REM-2 | GSD-2 | 625 nm |
| 6th Sensitive | FSEM-1 to 4 | IRSD-1 to 4 | 750 to 800 nm |

Reference and 4-Colorant Duplitized Photographic Elements 1 to 7

The following table describes the combinations of layers, emulsions and coupler dispersions that make up the control or reference 3-color element and the inventive 4-color duplitized elements. The first column of the table provides a reference code for an element combination. The second and third columns describe the layer orders of each of the different spectrally sensitized color records. The second column, titled 'Face Side', gives the colorant layer order starting with the layer furthest from the support. The third column, titled 'Reverse Side', describes the colorant used on the reverse side of the support, opposite the other color records. The fourth to the seventh columns describe the combination of emulsion and dispersion used in each layer and which were described in detail above.

The first two rows of the table provide the general compositions of two reference multilayer elements that are not duplitized. Reference element—1 shows the conventional and historic layer orders for conventional color papers. Reference element—2 provides an alternate combination of emulsions and dispersions. This combination of emulsions and dispersions results in an element that is false sensitized, in that the colorant produced by the layer is not complementary to the wavelength of light used to expose the layer. A design such as this requires that the element be printed using a digital exposing device due to the nature of color negative films.

Specific Composition of the Elements

The tables below contain the detailed composition of selected elements. The specific combination of the other examples cited can be ascertained from the table above and the element below.

TABLE 6

Reference Multilayer Element-1

| Layer/Function | Material | Coverage g/m$^2$ |
|---|---|---|
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |
| UV-Light Absorber-2 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |
| Red Light Sensitive Layer C | Gelatin | 1.356 |
| | Red Sensitive Silver REM-1 | 0.194 |
| | Coupler C-1 or | 0.381 |
| | C-2 | 0.237 |
| | Di-n-butyl phthalate | 0.381 |
| | Tinuvin 328 ™ | 0.245 |
| | 2-(2-butoxyethoxy)ethyl acetate | 0.0312 |
| | Di-t-octyl hydroquinone | 0.0035 |
| | Dye-3 | 0.0665 |
| UV-Light Absorber-1 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |
| Green Light Sensitive Layer M | Gelatin | 1.421 |
| | Green Sensitive Silver GEM-1 | 0.0785 |
| | Coupler M-2 | 0.237 |
| | Oleyl alcohol | 0.0846 |
| | Di-undecyl phthalate | 0.0362 |
| | ST-21 | 0.064 |
| | ST-22 | 0.604 |
| | 1-Phenyl-5-mercaptotetrazole | 0.0001 |
| | Dye-2 | 0.0602 |
| Interlayer | Gelatin | 0.753 |
| | Di-t-octyl hydroquinone | 0.108 |
| | Di-n-butyl phthalate | 0.308 |

TABLE 5

General Composition of the Reference and 4 Colorant Elements

| Reference and 4-Color Examples | Sensitized Layers: Face Side | Sensitized Layers: Reverse Side | Identification of Emulsion and Coupler Dispersions: CE/CD | ME/MD | YE/YD | KE/KD |
|---|---|---|---|---|---|---|
| Reference-1 | CMY | none | REM-1/CD | GEM-1/MD | BEM-1/YD | N/A |
| Reference-2 | CMY | none | GEM-1/CD | BEM-1/MD | REM-1/YD | N/A |
| 1-31-1 | CMY | K | REM-1/CD | GEM-1/MD | BEM-1/YD | FSEM-1/KD-1 |
| 2-31-2 | CYK | M | REM-1/CD | GEM-1/MD | BEM-1/YD | FSEM-2/KD-1 |
| 3-31-3 | MYK | C | REM-1/CD | GEM-1/MD | BEM-1/YD | FSEM-3/KD-1 |
| 4-31-4 | CMK | Y | REM-1/CD | GEM-1/MD | BEM-1/YD | FSEM-4/KD-1 |
| 5-22-1 | CK | MY | REM-1/CD | GEM-1/MD | BEM-1/YD | REM-2/KD-2 |
| 6-22-2 | CY | MK | REM-1/CD | GEM-1/MD | BEM-1/YD | BEM-2/KD-2 |
| 7-22-3 | CM | YK | REM-1/CD | GEM-1/MD | BEM-1/YD | BEM-2/KD-2 |

N/A is not applicable

TABLE 6-continued

Reference Multilayer Element-1

| Layer/Function | Material | Coverage g/m$^2$ |
|---|---|---|
| | Di-sodium 4,5 Di-hydroxy-m-benzene-disulfonate | 0.0129 |
| | SF-1 (Alkanol XC ™) | 0.0495 |
| | Irganox 1076 ™ | 0.0323 |
| Blue Light Sensitive Layer Y | Gelatin | 1.312 |
| | Blue Sensitive Silver BEM-1 | 0.227 |
| | Coupler Y-3 or | 0.414 |
| | Y5 | 0.414 |
| | ST-23 | 0.186 |
| | Tri-butyl citrate | 0.0001 |
| | 1-Phenyl-5-mercaptotetrazole | 0.009 |
| | Dye-1 | |
| Support | Resin Coated Color Paper Support or Transparent Polymeric Support | |

TABLE 7

Inventive Multilayer Element 1-31-1

| Layer/Function | Material | Coverage g/m$^2$ |
|---|---|---|
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |
| UV-Light Absorber-2 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |
| Layer C Red Light Sensitive | Gelatin | 1.356 |
| | Red Sensitive Silver REM-1 | 0.194 |
| | Coupler C-1 or | 0.381 |
| | C-2 | 0.237 |
| | Di-n-butyl phthalate | 0.381 |
| | Tinuvin 328 ™ | 0.245 |
| | 2-(2-butoxyethoxy)ethyl acetate | 0.0312 |
| | Di-t-octyl hydroquinone | 0.0035 |
| | Dye-3 | 0.0665 |
| UV-Light Absorber-1 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |
| Green Light Sensitive Layer M | Gelatin | 1.421 |
| | Green Sensitive Silver GEM-1 | 0.0785 |
| | Coupler M-2 | 0.237 |
| | Oleyl alcohol | 0.0846 |
| | Di-undecyl phthalate | 0.0362 |
| | ST-21 | 0.064 |
| | ST-22 | 0.604 |
| | 1-Phenyl-5-mercaptotetrazole | 0.0001 |
| | Dye-2 | 0.0602 |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzene-disulfonate | 0.0129 |
| | SF-1 (Alkanol XC ™) | 0.0495 |
| | Irganox 1076 ™ | 0.0323 |
| Blue Light Sensitive Layer Y | Gelatin | 1.312 |
| | Blue Sensitive Silver BEM-1 | 0.227 |
| | Coupler Y-3 or | 0.414 |

TABLE 7-continued

Inventive Multilayer Element 1-31-1

| Layer/Function | Material | Coverage g/m$^2$ |
|---|---|---|
| | Y5 | 0.414 |
| | ST-23 | 0.186 |
| | Tri-butyl citrate | 0.0001 |
| | 1-Phenyl-5-mercaptotetrazole | 0.009 |
| | Dye-1 | |
| Support | 2 to 7 mil Transparent Polymeric Support with Sub-coat on both sides | |
| IR Light Sensitive Layer Layer K | Gelatin | 1.076 |
| | Infrared Sensitive Silver FSEM-1 | 0.560 |
| | Coupler K73 | 0.270 |
| | N,N-diethyl lauramide | 0.54 |
| | 2-(2-butoxyethoxy)ethyl acetate | 0.0129 |
| Antihalation Layer | Gelatin | 1.29 |
| | Silver | 0.151 |
| | Versa TL-502 ™ | 0.0311 |
| | Di-t-octyl hydroquinone | 0.118 |
| | Di-n-butyl phthalate | 0.359 |
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |

TABLE 8

Inventive Multilayer Element 7-22-3

| Layer/Function | Material | Coverage g/m$^2$ |
|---|---|---|
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |
| UV-Light Absorber-2 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |
| Layer C Red Light Sensitive | Gelatin | 1.356 |
| | Red Sensitive Silver REM-1 | 0.194 |
| | Coupler C-1 or | 0.381 |
| | C-2 | 0.237 |
| | Di-n-butyl phthalate | 0.381 |
| | Tinuvin 328 ™ | 0.245 |
| | 2-(2-butoxyethoxy)ethyl acetate | 0.0312 |
| | Di-t-octyl hydroquinone | 0.0035 |
| | Dye-3 | 0.0665 |
| UV-Light Absorber-1 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |
| Green Light Sensitive Layer M | Gelatin | 1.421 |
| | Green Sensitive Silver GEM-1 | 0.0785 |
| | Coupler M-2 | 0.237 |
| | Oleyl alcohol | 0.0846 |
| | Di-undecyl phthalate | 0.0362 |
| | ST-21 | 0.064 |
| | ST-22 | 0.604 |
| | 1-Phenyl-5-mercaptotetrazole | 0.0001 |
| | Dye-2 | 0.0602 |

TABLE 8-continued

Inventive Multilayer Element 7-22-3

| Layer/Function | Material | Coverage g/m$^2$ |
|---|---|---|
| Support | 2 to 9 mil thick Transparent Polymeric Support with Sub-coat on both sides | |
| Blue Light Sensitive Layer Y | Gelatin | 1.312 |
| | Blue Sensitive Silver BEM-1 | 0.227 |
| | Coupler Y-3 or | 0.414 |
| | Y5 | 0.414 |
| | ST-23 | 0.186 |
| | Tri-butyl citrate | 0.0001 |
| | 1-Phenyl-5-mercaptotetrazole | 0.009 |
| | Dye-1 | |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzene-disulfonate | 0.0129 |
| | Alkanol XC ™ | 0.0495 |
| | Irganox 1076 ™ | 0.0323 |
| Blue Light Sensitive Layer K | Gelatin | 1.076 |
| | Blue Sensitive Silver BEM-2 | 0.350 |
| | Coupler C-1 | 0.19 |
| | Coupler M-1 | 0.14 |
| | Coupler Y-13 | 0.25 |
| | Di-n-butyl phthalate | 0.240 |
| Antihalation Layer | Gelatin | 1.29 |
| | Silver | 0.151 |
| | Versa TL-502 ™ | 0.0311 |
| | Di-t-octyl hydroquinone | 0.118 |
| | Di-n-butyl phthalate | 0.359 |
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |

Examples 8 to 22

The following table describes the combinations of layers, emulsions, and coupler dispersions that make up the inventive 5-color duplitized elements. The interpretation of the table is similar to that given in the examples above.

TABLE 10

Inventive Multilayer Element 8-41-1

| Layer/Function | Material | Coverage g/m$^2$ |
|---|---|---|
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |
| UV-Light Absorber-2 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |
| Layer C Red Light Sensitive | Gelatin | 1.356 |
| | Red Sensitive Silver REM-1 | 0.194 |
| | Coupler C-1 or | 0.381 |
| | C-2 | 0.237 |
| | Di-n-butyl phthalate | 0.381 |
| | Tinuvin 328 ™ | 0.245 |
| | 2-(2-butoxyethoxy)ethyl acetate | 0.0312 |
| | Di-t-octyl hydroquinone | 0.0035 |
| | Dye-3 | 0.0665 |
| UV-Light Absorber-1 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |
| Green Light Sensitive Layer M | Gelatin | 1.421 |
| | Green Sensitive Silver GEM-1 | 0.0785 |
| | Coupler M-2 | 0.237 |
| | Oleyl alcohol | 0.0846 |
| | Di-undecyl phthalate | 0.0362 |
| | ST-21 | 0.064 |
| | ST-22 | 0.604 |
| | 1-Phenyl-5-mercaptotetrazole | 0.0001 |
| | Dye-2 | 0.0602 |
| Interlayer | Gelatin | 0.753 |
| | Di-t-octyl hydroquinone | 0.108 |
| | Di-n-butyl phthalate | 0.308 |

TABLE 9

5 Colorant-Duplitized Photographic Elements

| 5-Color | Sensitized Layers | | Identification of Emulsion and Coupler Dispersions | | | | |
|---|---|---|---|---|---|---|---|
| Examples | Face Side | Reverse Side | CE/CD | ME/MD | YE/YD | KE/KD | XE/XD |
| 8-41-1 | CMYK | X | REM-1/CD | GEM-1/MD | BEM-1/YD | FSEM-1/KD-1 | BEM-2/XD |
| 9-41-2 | CMYX | K | REM-1/CD | GEM-1/MD | BEM-1/YD | FSEM-2/KD-2 | REM-2/XD |
| 10-41-3 | CMXK | Y | REM-1/CD | GEM-1/MD | BEM-1/YD | FSEM-3/KD-1 | FSEM-1/XD |
| 11-41-4 | CYXK | M | REM-1/CD | GEM-1/MD | BEM-1/YD | BEM-2/KD-1 | FSEM-1/XD |
| 12-41-5 | MYXK | C | REM-1/CD | GEM-1/MD | BEM-1/YD | REM-2/KD-1 | FSEM-1/XD |
| 13-32-1 | CMY | XK | REM-1/CD | GEM-1/MD | BEM-1/YD | FSEM-1/KD-2 | BEM-2/XD |
| 14-32-2 | CMX | YK | REM-1/CD | GEM-1/MD | BEM-1/YD | FSEM-2/KD-2 | REM-2/XD |
| 15-32-3 | CMK | XY | REM-1/CD | GEM-1/MD | BEM-1/YD | FSEM-3/KD-1 | BEM-2/XD |
| 16-32-4 | CYK | MX | REM-1/CD | GEM-1/MD | BEM-1/YD | FSEM-4/KD-1 | REM-2/XD |
| 17-32-5 | CYX | MK | REM-1/CD | GEM-1/MD | BEM-1/YD | BEM-2/KD-2 | FSEM-1/XD |
| 18-32-6 | CXK | MY | REM-1/CD | GEM-1/MD | BEM-1/YD | REM-2/KD-1 | FSEM-1/XD |
| 19-32-7 | YXK | CM | REM-1/CD | GEM-1/MD | BEM-1/YD | FSEM-1/KD-1 | REM-2/XD |
| 20-32-8 | MYX | CK | REM-1/CD | GEM-1/MD | BEM-1/YD | FSEM-2/KD-2 | BEM-2/XD |
| 21-32-9 | MYK | CX | REM-1/CD | GEM-1/MD | BEM-1/YD | FSEM-3/KD-1 | BEM-2/XD |
| 22-32-10 | MKX | CY | REM-1/CD | GEM-1/MD | BEM-1/YD | FSEM-4/KD-1 | REM-2/XD |

TABLE 10-continued

Inventive Multilayer Element 8-41-1

| Layer/Function | Material | Coverage g/m$^2$ |
|---|---|---|
| | Di-sodium 4,5 Di-hydroxy-m-benzene-disulfonate | 0.0129 |
| | Alkanol XC ™ | 0.0495 |
| | Irganox 1076 ™ | 0.0323 |
| Blue Light Sensitive Layer Y | Gelatin | 1.312 |
| | Blue Sensitive Silver BEM-1 | 0.227 |
| | Coupler Y-3 or | 0.414 |
| | Y5 | 0.414 |
| | ST-23 | 0.186 |
| | Tri-butyl citrate | 0.0001 |
| | 1-Phenyl-5-mercaptotetrazole | 0.009 |
| | Dye-1 | |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzene-disulfonate | 0.0129 |
| | Alkanol XC ™ | 0.0495 |
| | Irganox 1076 ™ | 0.0323 |
| IR Light Sensitive Layer K | Gelatin | 1.076 |
| | Infrared Sensitive Silver FSEM-1 | 0.560 |
| | Coupler K73 | 0.270 |
| | N,N-diethyl lauramide | 0.54 |
| | 2-(2-butoxyethoxy)ethyl acetate | 0.0129 |
| Support | 2 to 9 mil thick Transparent Polymeric Support with Sub-coat on both sides | |
| Layer X 5$^{th}$ Light Sensitive Layer | Gelatin | 1.356 |
| | Blue Sensitive Silver BEM-2 | 0.194 |
| | Coupler IB-1 | 0.381 |
| | Di-n-butyl phthalate | 0.381 |
| | Tinuvin 328 ™ | 0.245 |
| | 2-(2-butoxyethoxy)ethyl acetate | 0.0312 |
| | Di-t-octyl hydroquinone | 0.0035 |
| | Dye-3 | 0.0665 |
| Antihalation Layer | Gelatin | 1.29 |
| | Silver | 0.151 |
| | Versa TL-502 ™ | 0.0311 |
| | Di-t-octyl hydroquinone | 0.118 |
| | Di-n-butyl phthalate | 0.359 |
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |

TABLE 11

Inventive Multilayer Element 14-32-2

| Layer/Function | Material | Coverage g/m$^2$ |
|---|---|---|
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |
| UV-Light Absorber-2 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |

TABLE 11-continued

Inventive Multilayer Element 14-32-2

| Layer/Function | Material | Coverage g/m$^2$ |
|---|---|---|
| Layer C Red Light Sensitive | Gelatin | 1.356 |
| | Red Sensitive Silver REM-1 | 0.194 |
| | Coupler C-1 or | 0.381 |
| | C-2 | 0.237 |
| | Di-n-butyl phthalate | 0.381 |
| | Tinuvin 328 ™ | 0.245 |
| | 2-(2-butoxyethoxy)ethyl acetate | 0.0312 |
| | Di-t-octyl hydroquinone | 0.0035 |
| | Dye-3 | 0.0665 |
| UV-Light Absorber-1 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |
| Green Light Sensitive Layer M | Gelatin | 1.421 |
| | Green Sensitive Silver GEM-1 | 0.0785 |
| | Coupler M-2 | 0.237 |
| | Oleyl alcohol | 0.0846 |
| | Di-undecyl phthalate | 0.0362 |
| | ST-21 | 0.064 |
| | ST-22 | 0.604 |
| | 1-Phenyl-5-mercaptotetrazole | 0.0001 |
| | Dye-2 | 0.0602 |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzene-disulfonate | 0.0129 |
| | Alkanol XC ™ | 0.0495 |
| | Irganox 1076 ™ | 0.0323 |
| Layer X 5$^{th}$ Light Sensitive Layer | Gelatin | 1.421 |
| | Red Sensitive Silver REM-2 | 0.0785 |
| | Coupler IR-7 | 0.237 |
| | Oleyl alcohol | 0.0846 |
| | Di-undecyl phthalate | 0.0362 |
| | ST-21 | 0.064 |
| | ST-22 | 0.604 |
| | 1-Phenyl-5-mercaptotetrazole | 0.0001 |
| | Dye-2 | 0.0602 |
| Support | 2 to 9 mil thick Transparent Polymeric Support with Sub-coat on both sides | |
| Blue Light Sensitive Layer Y | Gelatin | 1.312 |
| | Blue Sensitive Silver BEM-1 | 0.227 |
| | Coupler Y-3 or | 0.414 |
| | Y5 | 0.414 |
| | ST-23 | 0.186 |
| | Tri-butyl citrate | 0.0001 |
| | 1-Phenyl-5-mercaptotetrazole | 0.009 |
| | Dye-1 | |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzene-disulfonate | 0.0129 |
| | Alkanol XC ™ | 0.0495 |
| | Irganox 1076 ™ | 0.0323 |
| Infrared Light Sensitive Layer K | Gelatin | 1.076 |
| | Infrared Sensitive Silver FSEM-2 | 0.350 |
| | Coupler C-1 | 0.19 |
| | Coupler M-1 | 0.14 |
| | Coupler Y-13 | 0.25 |
| | Di-n-butyl phthalate | 0.240 |
| Antihalation Layer | Gelatin | 1.29 |
| | Silver | 0.151 |
| | Versa TL-502 ™ | 0.0311 |
| | Di-t-octyl hydroquinone | 0.118 |

TABLE 11-continued

| Inventive Multilayer Element 14-32-2 | | |
|---|---|---|
| Layer/Function | Material | Coverage g/m$^2$ |
| | Di-n-butyl phthalate | 0.359 |
| | 1,4-Cyclohexylenedimethylene bis(2-ethylhexanoate) | 0.0717 |
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |

Examples 23 to 53

The following table describes the combinations of layers, emulsions, and coupler dispersions that make up the inventive 6-color duplitized elements. The interpretation of the table is similar to that given in the examples above.

TABLE 12

6 Colorant Duplitized Photographic Elements

| 6-Color | Sensitized Layers | | Identification of Emulsion and Coupler Dispersions | | | | | |
|---|---|---|---|---|---|---|---|---|
| Examples | Face Side | Reverse Side | CE/CD | ME/MD | YE/YD | KE/KD | XE/XD | ZE/ZD |
| 23-51-1 | CMYKX | Z | REM-1/CD | GEM-1/MD | BEM-1/YD | REM-2/KD-1 | BEM-2/XD | FSEM-1/ZD |
| 24-51-2 | CMYKZ | X | REM-1/CD | GEM-1/MD | BEM-1/YD | REM-2/KD-1 | BEM-2/XD | FSEM-4/ZD |
| 25-51-3 | CMYXZ | K | REM-1/CD | GEM-1/MD | BEM-1/YD | BEM-2/KD-2 | REM-2/XD | FSEM-2/ZD |
| 26-51-4 | CMKXZ | Y | REM-1/CD | GEM-1/MD | BEM-1/YD | REM-2/KD-1 | BEM-2/XD | FSEM-3/ZD |
| 27-51-5 | CYKXZ | M | REM-1/CD | GEM-1/MD | BEM-1/YD | REM-2/KD-1 | BEM-2/XD | FSEM-4/ZD |
| 28-51-6 | MYXK | C | REM-1/CD | GEM-1/MD | BEM-1/YD | REM-2/KD-1 | BEM-2/XD | FSEM-2/ZD |
| 29-42-1 | CMYK | XZ | REM-1/CD | GEM-1/MD | BEM-1/YD | REM-2/KD-1 | BEM-2/XD | FSEM-3/ZD |
| 30-42-2 | CMYX | KZ | REM-1/CD | GEM-1/MD | BEM-1/YD | BEM-2/KD-2 | REM-2/XD | FSEM-4/ZD |
| 31-42-3 | CMKZ | YZ | REM-1/CD | GEM-1/MD | BEM-1/YD | REM-2/KD-1 | BEM-2/XD | FSEM-1/ZD |
| 32-42-4 | CYKX | MZ | REM-1/CD | GEM-1/MD | BEM-1/YD | REM-2/KD-1 | BEM-2/XD | FSEM-2/ZD |
| 33-42-5 | MYKX | CZ | REM-1/CD | GEM-1/MD | BEM-1/YD | REM-2/KD-1 | BEM-2/XD | FSEM-3/ZD |
| 34-42-6 | CMYZ | KX | REM-1/CD | GEM-1/MD | BEM-1/YD | BEM-2/KD-2 | REM-2/XD | FSEM-4/ZD |
| 35-42-7 | CMKZ | YX | REM-1/CD | GEM-1/MD | BEM-1/YD | REM-2/KD-1 | BEM-2/XD | FSEM-3/ZD |
| 36-42-8 | CYKZ | MX | REM-1/CD | GEM-1/MD | BEM-1/YD | REM-2/KD-1 | BEM-2/XD | FSEM-2/ZD |
| 37-42-9 | MYKZ | CX | REM-1/CD | GEM-1/MD | BEM-1/YD | REM-2/KD-1 | BEM-2/XD | FSEM-1/ZD |
| 38-42-10 | CMXZ | YK | REM-1/CD | GEM-1/MD | BEM-1/YD | BEM-2/KD-2 | REM-2/XD | FSEM-2 ZD |
| 39-42-11 | CYXZ | MK | REM-1/CD | GEM-1/MD | BEM-1/YD | BEM-2/KD-2 | REM-2/XD | FSEM-4/ZD |
| 40-42-12 | MYXZ | CK | REM-1/CD | GEM-1/MD | BEM-1/YD | BEM-2/KD-2 | REM-2/XD | FSEM-1/ZD |
| 41-42-13 | CKXY | MY | REM-1/CD | GEM-1/MD | BEM-1/YD | REM-2/KD-1 | BEM-2/XD | FSEM-1/ZD |
| 42-42-14 | MKXY | CY | REM-1/CD | GEM-1/MD | BEM-1/YD | REM-2/KD-1 | BEM-2/XD | FSEM-4/ZD |
| 43-42-15 | YKXZ | CM | REM-1/CD | GEM-1/MD | BEM-1/YD | REM-2/KD-1 | BEM-2/XD | FSEM-3/ZD |

TABLE 12-continued

6 Colorant Duplitized Photographic Elements

| 6-Color Examples | Sensitized Layers Face Side | Sensitized Layers Reverse Side | Identification of Emulsion and Coupler Dispersions CE/CD | ME/MD | YE/YD | KE/KD | XE/XD | ZE/ZD |
|---|---|---|---|---|---|---|---|---|
| 44-33-1 | CMY | KXZ | REM-1/CD | GEM-1/MD | BEM-1/YD | BEM-2/KD-2 | REM-2/XD | FSEM-2/ZD |
| 45-33-2 | CMK | YXZ | REM-1/CD | GEM-1/MD | BEM-1/YD | REM-2/KD-1 | BEM-2/XD | FSEM-1/ZD |
| 46-33-3 | CYK | MXZ | REM-1/CD | GEM-1/MD | BEM-1/YD | REM-2/KD-1 | BEM-2/XD | FSEM-4/ZD |
| 47-33-4 | MYK | CXZ | REM-1/CD | GEM-1/MD | BEM-1/YD | REM-2/KD-1 | BEM-2/XD | FSEM-4/ZD |
| 48-33-5 | CMX | KYZ | REM-1/CD | GEM-1/MD | BEM-1/YD | REM-2/KD-1 | BEM-2/XD | FSEM-4/ZD |
| 49-33-6 | CKX | MYZ | REM-1/CD | GEM-1/MD | BEM-1/YD | REM-2/KD-1 | BEM-2/XD | FSEM-4/ZD |
| 50-33-7 | MKX | CYZ | REM-1/CD | GEM-1/MD | BEM-1/YD | REM-2/KD-1 | BEM-2/XD | FSEM-3/ZD |
| 51-33-8 | CYX | KMZ | REM-1/CD | GEM-1/MD | BEM-1/YD | REM-2/KD-1 | BEM-2/XD | FSEM-3/ZD |
| 52-33-9 | YKX | CMZ | REM-1/CD | GEM-1/MD | BEM-1/YD | REM-2/KD-1 | BEM-2/XD | FSEM-3/ZD |
| 53-33-10 | CMX | KCZ | REM-1/CD | GEM-1/MD | BEM-1/YD | REM-2/KD-1 | BEM-2/XD | FSEM-4/ZD |

TABLE 13

Inventive Multilayer Element 25-51-3

| Layer/Function | Material | Coverage g/m$^2$ |
|---|---|---|
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |
| UV-Light Absorber-2 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |
| Layer C Red Light Sensitive | Gelatin | 1.356 |
| | Red Sensitive Silver REM-1 | 0.194 |
| | Coupler C-1 or | 0.381 |
| | C-2 | 0.237 |
| | Di-n-butyl phthalate | 0.381 |
| | Tinuvin 328 ™ | 0.245 |
| | 2-(2-butoxyethoxy)ethyl acetate | 0.0312 |
| | Di-t-octyl hydroquinone | 0.0035 |
| | Dye-3 | 0.0665 |
| UV-Light Absorber-1 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |
| Green Light Sensitive Layer M | Gelatin | 1.421 |
| | Green Sensitive Silver GEM-1 | 0.0785 |
| | Coupler M-2 | 0.237 |
| | Oleyl alcohol | 0.0846 |
| | Di-undecyl phthalate | 0.0362 |
| | ST-21 | 0.064 |
| | ST-22 | 0.604 |

TABLE 13-continued

Inventive Multilayer Element 25-51-3

| Layer/Function | Material | Coverage g/m$^2$ |
|---|---|---|
| | 1-Phenyl-5-mercaptotetrazole | 0.0001 |
| | Dye-2 | 0.0602 |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzenedisulfonate | 0.0129 |
| | Alkanol XC ™ | 0.0495 |
| | Irganox 1076 ™ | 0.0323 |
| Blue Light Sensitive Layer Y | Gelatin | 1.312 |
| | Blue Sensitive Silver BEM-1 | 0.227 |
| | Coupler Y-3 or | 0.414 |
| | Y5 | 0.414 |
| | ST-23 | 0.186 |
| | Tri-butyl citrate | 0.0001 |
| | 1-Phenyl-5-mercaptotetrazole | 0.009 |
| | Dye-1 | |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzenedisulfonate | 0.0129 |
| | Alkanol XC ™ | 0.0495 |
| | Irganox 1076 ™ | 0.0323 |
| Layer X 4$^{th}$ Light Sensitive Layer | Gelatin | 1.421 |
| | Red Sensitive Silver REM-2 | 0.0785 |
| | Coupler IR-7 | 0.237 |
| | Oleyl alcohol | 0.0846 |
| | Di-undecyl phthalate | 0.0362 |
| | ST-21 | 0.064 |
| | ST-22 | 0.604 |
| | 1-Phenyl-5-mercaptotetrazole | 0.0001 |
| | Dye-2 | 0.0602 |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzenedisulfonate | 0.0129 |

TABLE 13-continued

Inventive Multilayer Element 25-51-3

| Layer/Function | Material | Coverage g/m$^2$ |
|---|---|---|
| | Alkanol XC ™ | 0.0495 |
| | Irganox 1076 ™ | 0.0323 |
| Layer Z | Gelatin | 1.356 |
| 5$^{th}$ Light Sensitive | Infrared Sensitive Silver FSEM-2 | 0.194 |
| Layer | Coupler IB-I | 0.381 |
| | Di-n-butyl phthalate | 0.381 |
| | Tinuvin 328 ™ | 0.245 |
| | 2-(2-butoxyethoxy)ethyl acetate | 0.0312 |
| | Di-t-octyl hydroquinone | 0.0035 |
| | Dye-3 | 0.0665 |
| Support | 2 to 9 mil thick Transparent Polymeric Support with Sub-coat on both sides | |
| Blue Light | Gelatin | 1.076 |
| Sensitive Layer | Blue Sensitive Silver BEM-2 | 0.350 |
| Layer K | Coupler C-1 | 0.19 |
| | Coupler M-1 | 0.14 |
| | Coupler Y-13 | 0.25 |
| | Di-n-butyl phthalate | 0.240 |
| Antihalation Layer | Gelatin | 1.29 |
| | Silver | 0.151 |
| | Versa TL-502 ™ | 0.0311 |
| | Di-t-octyl hydroquinone | 0.118 |
| | Di-n-butyl phthalate | 0.359 |
| | 1,4-Cyclohexylenedimethylene bis(2-ethylhexanoate) | 0.0717 |
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |

TABLE 14

Inventive Multilayer Element 38-42-10

| Layer/Function | Material | Coverage g/m$^2$ |
|---|---|---|
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |
| UV-Light | Gelatin | 0.624 |
| Absorber-2 | Tinuvin 328 ™ | 0.156 |
| | Tinuvin 326 ™ | 0.027 |
| | Di-t-octyl hydroquinone | 0.0485 |
| | Cyclohexane-dimethanol-bis-2- | 0.18 |
| | Di-n-butyl phthalate | 0.18 |
| Layer C | Gelatin | 1.356 |
| Red Light Sensitive | Red Sensitive Silver REM-1 | 0.194 |
| | Coupler C-1 or | 0.381 |
| | C-2 | 0.237 |
| | Di-n-butyl phthalate | 0.381 |
| | Tinuvin 328 ™ | 0.245 |
| | 2-(2-butoxyethoxy)ethyl acetate | 0.0312 |
| | Di-t-octyl hydroquinone | 0.0035 |
| | Dye-3 | 0.0665 |
| UV-Light | Gelatin | 0.624 |
| Absorber-1 | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |

TABLE 14-continued

Inventive Multilayer Element 38-42-10

| Layer/Function | Material | Coverage g/m$^2$ |
|---|---|---|
| Green Light | Gelatin | 1.421 |
| Sensitive | Green Sensitive Silver GEM-1 | 0.0785 |
| Layer M | Coupler M-2 | 0.237 |
| | Oleyl alcohol | 0.0846 |
| | Di-undecyl phthalate | 0.0362 |
| | ST-21 | 0.064 |
| | ST-22 | 0.604 |
| | 1-Phenyl-5-mercaptotetrazole | 0.0001 |
| | Dye-2 | 0.0602 |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzenedisulfonate | 0.0129 |
| | Alkanol XC ™ | 0.0495 |
| | Irganox 1076 ™ | 0.0323 |
| Layer X | Gelatin | 1.421 |
| 3$^{rd}$ Light Sensitive | Red Sensitive Silver REM-2 | 0.0785 |
| Layer | Coupler IR-7 | 0.237 |
| | Oleyl alcohol | 0.0846 |
| | Di-undecyl phthalate | 0.0362 |
| | ST-21 | 0.064 |
| | ST-22 | 0.604 |
| | 1-Phenyl-5-mercaptotetrazole | 0.0001 |
| | Dye-2 | 0.0602 |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzenedisulfonate | 0.0129 |
| | Alkanol XC ™ | 0.0495 |
| | Irganox 1076 ™ | 0.0323 |
| Layer Z | Gelatin | 1.356 |
| 4$^{th}$ Light Sensitive | Infrared Sensitive Silver FSEM-2 | 0.194 |
| Layer | Coupler IB-1 | 0.381 |
| | Di-n-butyl phthalate | 0.381 |
| | Tinuvin 328 ™ | 0.245 |
| | 2-(2-butoxyethoxy)ethyl acetate | 0.0312 |
| | Di-t-octyl hydroquinone | 0.0035 |
| | Dye-3 | 0.0665 |
| Support | 2 to 9 mil thick Transparent Polymeric Support with Sub-coat on both sides | |
| Blue Light | Gelatin | 1.312 |
| Sensitive | Blue Sensitive Silver BEM-1 | 0.227 |
| Layer Y | Coupler Y-3 or | 0.414 |
| | Y5 | 0.414 |
| | ST-23 | 0.186 |
| | Tri-butyl citrate | 0.0001 |
| | 1-Phenyl-5-mercaptotetrazole | 0.009 |
| | Dye-1 | |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzenedisulfonate | 0.0129 |
| | Alkanol XC ™ | 0.0495 |
| | Irganox 1076 ™ | 0.0323 |
| Blue Light | Gelatin | 1.076 |
| Sensitive Layer | Blue Sensitive Silver BEM-2 | 0.350 |
| Layer K | Coupler C-1 | 0.19 |
| | Coupler M-1 | 0.14 |
| | Coupler Y-13 | 0.25 |
| | Di-n-butyl phthalate | 0.240 |
| Antihalation Layer | Gelatin | 1.29 |
| | Silver | 0.151 |
| | Versa TL-502 ™ | 0.0311 |
| | Di-t-octyl hydroquinone | 0.118 |
| | Di-n-butyl phthalate | 0.359 |
| | 1,4-Cyclohexylenedimethylene bis(2-ethylhexanoate) | 0.0717 |

TABLE 14-continued

| Inventive Multilayer Element 38-42-10 | | |
|---|---|---|
| Layer/Function | Material | Coverage g/m$^2$ |
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |

TABLE 15

| Inventive Multilayer Element 44-33-1 | | |
|---|---|---|
| Layer/Function | Material | Coverage g/m$^2$ |
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |
| UV-Light Absorber-2 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |
| Layer C Red Light Sensitive | Gelatin | 1.356 |
| | Red Sensitive Silver REM-1 | 0.194 |
| | Coupler C-1 or | 0.381 |
| | C-2 | 0.237 |
| | Di-n-butyl phthalate | 0.381 |
| | Tinuvin 328 ™ | 0.245 |
| | 2-(2-butoxyethoxy)ethyl acetate | 0.0312 |
| | Di-t-octyl hydroquinone | 0.0035 |
| | Dye-3 | 0.0665 |
| UV-Light Absorber-1 | Gelatin | 0.624 |
| | Tinuvin 328 ™ | 0.156 |
| | Tinuvin 326 ™ | 0.027 |
| | Di-t-octyl hydroquinone | 0.0485 |
| | Cyclohexane-dimethanol-bis-2-ethylhexanoic acid | 0.18 |
| | Di-n-butyl phthalate | 0.18 |
| Green Light Sensitive Layer M | Gelatin | 1.421 |
| | Green Sensitive Silver GEM-1 | 0.0785 |
| | Coupler M-2 | 0.237 |
| | Oleyl alcohol | 0.0846 |
| | Di-undecyl phthalate | 0.0362 |
| | ST-21 | 0.064 |
| | ST-22 | 0.604 |
| | 1-Phenyl-5-mercaptotetrazole | 0.0001 |
| | Dye-2 | 0.0602 |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzenedisulfonate | 0.0129 |
| | Alkanol XC ™ | 0.0495 |
| | Irganox 1076 ™ | 0.0323 |
| Blue Light Sensitive Layer Y | Gelatin | 1.312 |
| | Blue Sensitive Silver BEM-1 | 0.227 |
| | Coupler Y-3 or | 0.414 |
| | Y5 | 0.414 |
| | ST-23 | 0.186 |
| | Tri-butyl citrate | 0.0001 |
| | 1-Phenyl-5-mercaptotetrazole | 0.009 |
| | Dye-1 | |

TABLE 15-continued

| Inventive Multilayer Element 44-33-1 | | |
|---|---|---|
| Layer/Function | Material | Coverage g/m$^2$ |
| Support | 2 to 9 mil thick Transparent Polymeric Support with Sub-coat on both sides | |
| Blue Light Sensitive Layer K | Gelatin | 1.076 |
| | Blue Sensitive Silver BEM-2 | 0.350 |
| | Coupler C-1 | 0.19 |
| | Coupler M-1 | 0.14 |
| | Coupler Y-13 | 0.25 |
| | Di-n-butyl phthalate | 0.240 |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzenedisulfonate | 0.0129 |
| | Alkanol XC ™ | 0.0495 |
| | Irganox 1076 ™ | 0.0323 |
| Layer X 4$^{th}$ Light Sensitive Layer | Gelatin | 1.421 |
| | Red Sensitive Silver REM-2 | 0.0785 |
| | Coupler IR-7 | 0.237 |
| | Oleyl alcohol | 0.0846 |
| | Di-undecyl phthalate | 0.0362 |
| | ST-21 | 0.064 |
| | ST-22 | 0.604 |
| | 1-Phenyl-5 -mercaptotetrazole | 0.0001 |
| | Dye-2 | 0.0602 |
| Interlayer | Gelatin | 0.753 |
| | Di-t-octyl hydroquinone | 0.108 |
| | Di-n-butyl phthalate | 0.308 |
| | Di-sodium 4,5 Di-hydroxy-m-benzenedisulfonate | 0.0129 |
| | Alkanol XC ™ | 0.0495 |
| | Irganox 1076 ™ | 0.0323 |
| Layer Z 5$^{th}$ Light Sensitive Layer | Gelatin | 1.356 |
| | Infrared Sensitive Silver FSEM-2 | 0.194 |
| | Coupler IB-1 | 0.381 |
| | Di-n-butyl phthalate | 0.381 |
| | Tinuvin 328 ™ | 0.245 |
| | 2-(2-butoxyethoxy)ethyl acetate | 0.0312 |
| | Di-t-octyl hydroquinone | 0.0035 |
| | Dye-3 | 0.0665 |
| Antihalation Layer | Gelatin | 1.29 |
| | Silver | 0.151 |
| | Versa TL-502 ™ | 0.0311 |
| | Di-t-octyl hydroquinone | 0.118 |
| | Di-n-butyl phthalate | 0.359 |
| | 1,4-Cyclohexylenedimethylene bis(2-ethylhexanoate) | 0.0717 |
| Protective Overcoat | Gelatin | 0.645 |
| | Dow Corning DC200 ™ | 0.0202 |
| | Ludox AM ™ | 0.1614 |
| | Di-t-octyl hydroquinone | 0.013 |
| | Di-n-butyl phthalate | 0.039 |
| | Alkanol XC ™ | 0.009 |
| | FT-248 | 0.004 |

Chemical Structures for Multilayer Elements
C-1
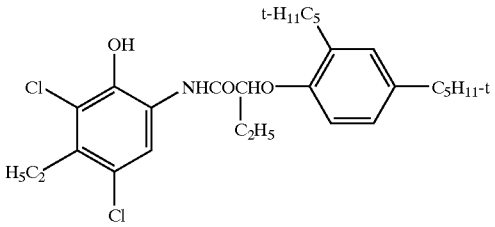
C-2
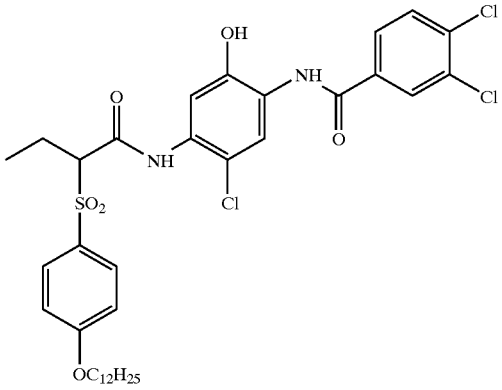
M-1
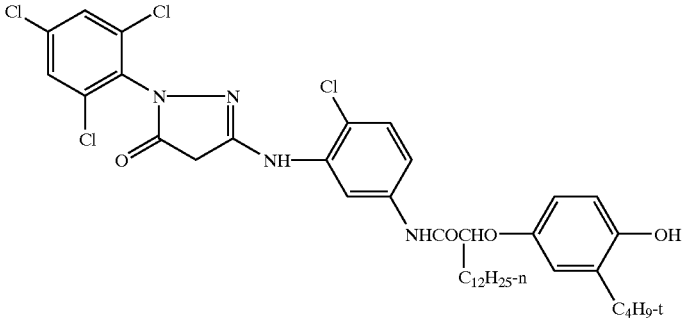
M-2
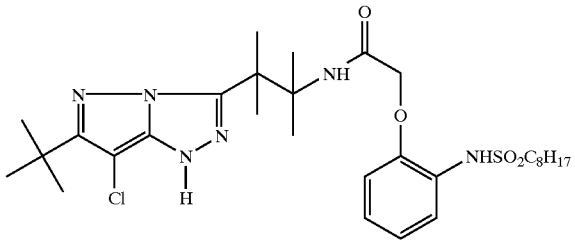
Y-3
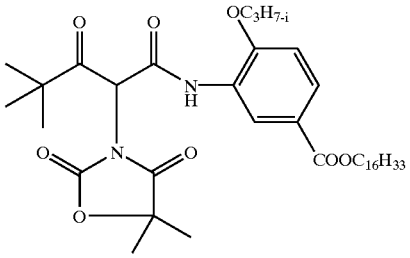
Y-5
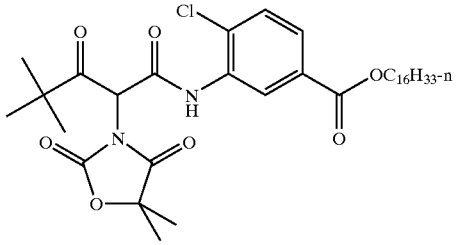
BSD-2
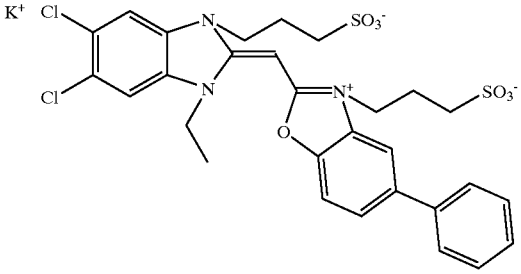
BSD-4
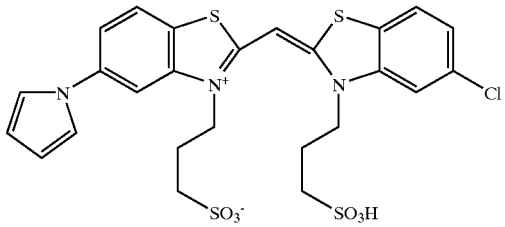
DYE-1
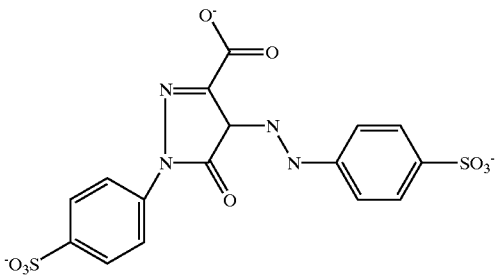

-continued
DYE-2
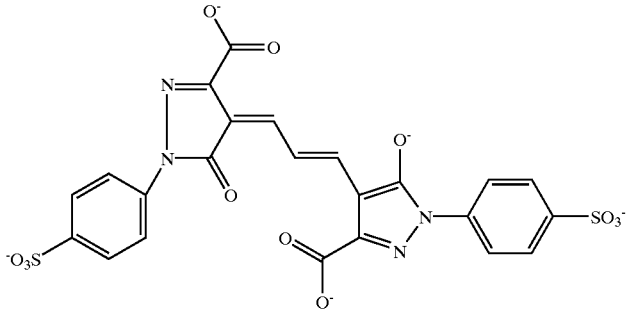
DYE-3
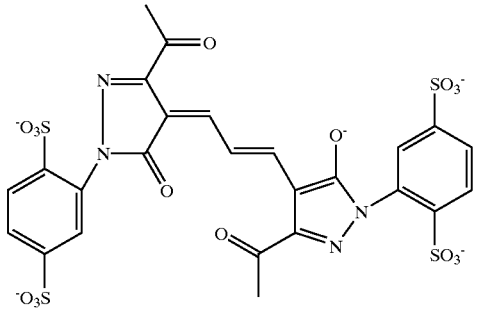
DYE-4
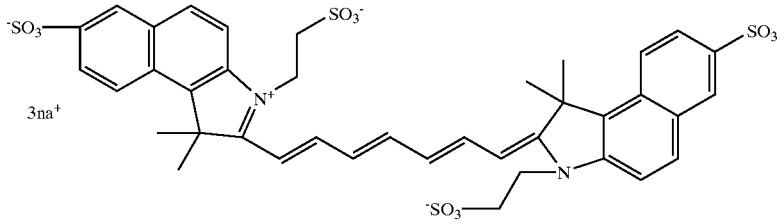
DYE-5
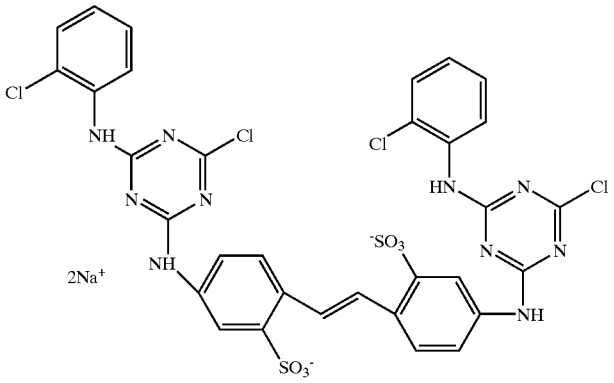
GSD-1
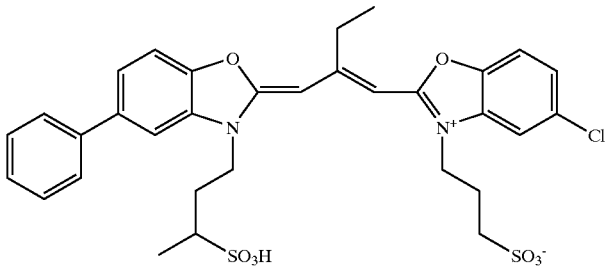

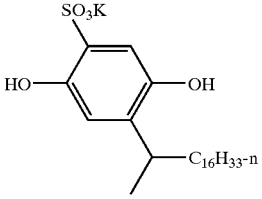

-continued
GSD-2
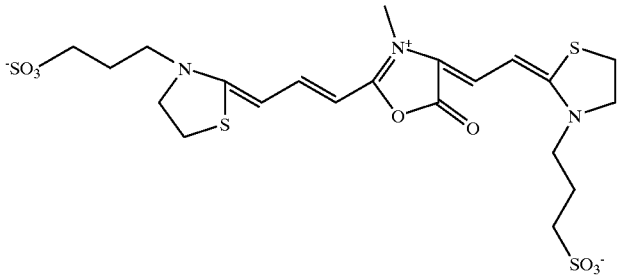
IRSD-1
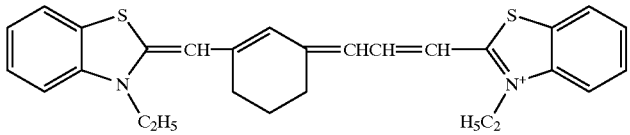
IRSD-2
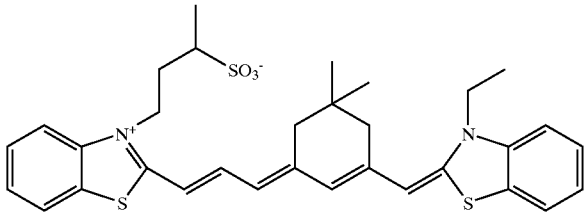
IRSD-3
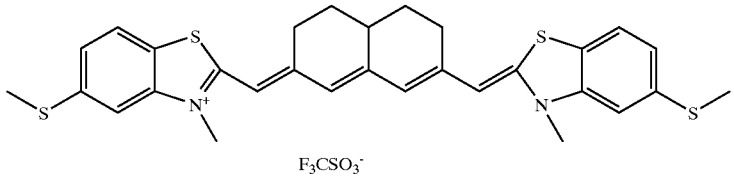
IRSD-4
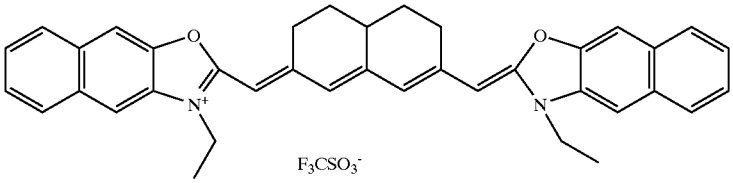
RSD-1
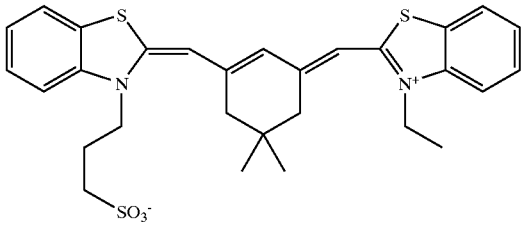
ST-6
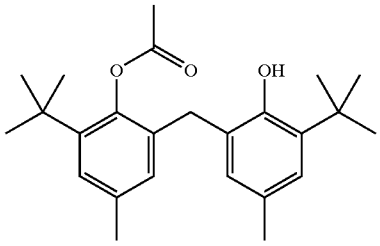
ST-8
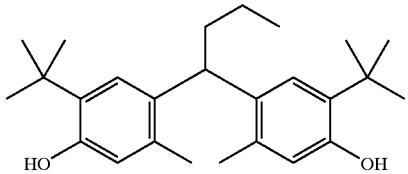
ST-16